US006674362B2

(12) United States Patent
Yoshioka et al.

(10) Patent No.: US 6,674,362 B2
(45) Date of Patent: Jan. 6, 2004

(54) EMERGENCY INFORMING TERMINAL AND EMERGENCY INFORMING SYSTEM INCLUDING THE TERMINAL

(75) Inventors: Kenji Yoshioka, Kanagawa (JP); Takeshi Inui, Osaka (JP); Takayuki Tanahashi, Osaka (JP); Toshiyuki Shimizu, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/921,626

(22) Filed: Aug. 3, 2001

(65) Prior Publication Data

US 2002/0075165 A1 Jun. 20, 2002

(30) Foreign Application Priority Data

| | | |
|---|---|---|
| Aug. 4, 2000 | (JP) | 2000-237045 |
| Aug. 24, 2000 | (JP) | 2000-253498 |
| Apr. 3, 2001 | (JP) | 2001-104793 |
| Apr. 3, 2001 | (JP) | 2001-104795 |

(51) Int. Cl.[7] ..... G08B 29/00
(52) U.S. Cl. ..... 340/506; 340/438; 340/508
(58) Field of Search ..... 340/506, 505, 340/508, 426.1, 438, 3.1; 455/456, 433

(56) References Cited

U.S. PATENT DOCUMENTS 6,337,621 B1 * 1/2002 Ogino et al. ..... 340/425.5

FOREIGN PATENT DOCUMENTS

| | | |
|---|---|---|
| JP | 9-151780 | 6/1997 |
| JP | 9-198592 | 7/1997 |

* cited by examiner

*Primary Examiner*—Daryl Pope
(74) *Attorney, Agent, or Firm*—RatnerPrestia

(57) ABSTRACT

A main controller for controlling an emergency informing terminal, and a sub controller for controlling communications with an external device are provided. The main controller and sub controller have microcomputers, and the main controller and sub controller monitor the operation of each other. If the other is abnormal, a reset signal is issued to initialize it, and if still abnormal, the history of abnormality is recorded, and the abnormality is informed to the user by means of sound or light.

The power source device of this emergency informing terminal has a function of cutting off power supply to the emergency informing terminal when overheat or overcurrent occurs in the auxiliary battery which operate when supply from the main battery is interrupted, and if overheat or voltage drop occurs due to short circuit of the auxiliary battery or other trouble, power supply into the emergency informing terminal is cut off, so that spread of damage may be avoided.

62 Claims, 18 Drawing Sheets

EMERGENCY INFORMING TERMINAL AND EMERGENCY INFORMING SYSTEM INCLUDING THE TERMINAL

FIELD OF THE INVENTION

The present invention relates to an emergency informing system including an emergency informing terminal mounted on a vehicle or other mobile body for communicating with the center supervising emergency informing system in case of emergency, and the emergency call center supervising the emergency informing system for receiving an emergency call send signal from this emergency informing terminal. More specifically, it relates to a system having a countermeasure function against abnormality such as failure of emergency informing terminal.

The invention further relates to a system designed to cut off power supply to the emergency informing terminal by judging abnormality, in particular, when the supply voltage of the auxiliary battery drops or a current flows more than specified in the emergency informing terminal.

BACKGROUND OF THE INVENTION

Hitherto, an emergency informing terminal is mounted on an automobile or other vehicle, and is used in communication with the center supervising the emergency informing system such as the police or emergency call center, through a base station of communications operator or the like, in case of emergency such as traffic accident or sickness while driving.

FIG. 17 is a block diagram of a transmitter of a conventional emergency informing system disclosed in Japanese Laid-open Patent No. 9-198592, and its operation is explained below. As shown in FIG. 17, the transmitter 70 of this emergency informing system comprises GPS receiving means 71, main control means 72, emergency call notifying means 73, input, display and talk means 74, memory means 75, failure detecting means 76, and a power source 77, and they are mutually connected through data bus 700. The GPS receiving means 71 receives position information and other data through a GPS data link 701. The main control means 72 periodically reads out reception data from the GPS receiving means 71, calculates time data and position data, and stores in the memory means 75. The main control means 72 controls the entire transmitter 70. The emergency call notifying means 73 controls a call to connect the transmitter 70 to a wireless public telephone line 702, and the input, display and talk means 74 enters and displays the telephone number of the partner, talks with the partner, and enters the control information to the transmitter 70. The failure detecting means 76 detects abnormality when, for example, impact, heat or rotation is applied to the automobile or other mobile body on which the transmitter 70 is mounted, and notifies this abnormality to the main control means 72. The power source 77 receives supply of main power source from the mobile body, and feeds its power to individual means. The power source 77 also functions as a backup power source for the transmitter 70 in case the main power source of the mobile body is cut off.

In the configuration of this conventional transmitter 70, the GPS receiving means 71 receives position information through the GPS data link 701, and the main control means 72 periodically reads out reception data from the GPS receiving means 71, calculates time data and position data on the basis of the position information, and updates the content of the memory means 75 by the latest time data and position data obtained by the calculation. On the other hand, the failure detecting means 76 is always monitoring for abnormality due to impact, heat, rotation or the like in the automobile or other mobile body on which the transmitter 70 is mounted, and when detecting abnormality, it notifies to the main control means 72. Receiving the notice of detection of abnormality from the failure detecting means 76, the main control means 72 control the emergency call notifying means 73, and connects the dialing line to the center for supervising the emergency informing system, and transmits the failure occurrence message created by including the latest time data and position data stored in the memory means 75 to the center. As a result, if communication from the driver to outside is disabled due to accident of the mobile body or the like, occurrence of abnormality of the mobile body can be promptly transmitted, together with the position information, to outside.

On the other hand, the technology for enhancing the safety of the vehicle by enhancing the reliability of the automobile or other vehicle is disclosed, for example, in Japanese Laid-open Patent No. 9-151780. In the electronic control unit (ECU) such as engine control unit in which control objects in the vehicle are distributed by function, a microcomputer may be used for electronic control. When composing the control system by using microcomputer, all controls may not be always done by one microcomputer only, but control processes may be divided into plural groups, and one microcomputer is assigned for one process, and the data of other microcomputer necessary in each microcomputer is obtained through a communication path which connects all microcomputers, which is known as multi-microcomputer system. FIG. 18 is a block diagram showing an example of configuration of such multi-microcomputer system, in which an electronic control unit 90 is composed of two microcomputers, that is, a first microcomputer 91 and a second microcomputer 92 connected through a communication path 93, and a first control object 94 and a second control object 95 are controlled. In such constitution, while mutual microcomputers exchanged data, the microcomputers monitor abnormality of each other through the communication path 93, and the reliability of electronic control unit is enhanced, and the reliability of the vehicle itself is enhanced.

Thus, to enhance the safety of the automobile, while enhancing the reliability of the vehicle itself, it is simultaneously attempted to improve the emergency informing system for informing an emergency case of the automobile to the center for supervising the emergency informing system promptly from the emergency informing terminal.

However, in the transmitter of the conventional emergency informing system shown in FIG. 17, in case of emergency such as accident of the automobile itself or sickness, the occurrence of abnormality is notified to the center by the emergency informing system by the driver or by failure detecting means. Further, by the main control means for controlling the entire transmitter, the operation is managed including the abnormality of the transmitter itself. In the event of trouble or abnormality of the main control means, however, the main control means itself is abnormal, and the abnormality cannot be noticed to the user, and the abnormal state is left as it is, and further since the abnormality history cannot be recorded, it is difficult to identify the cause of abnormality.

Meanwhile, in the multi-microcomputer system as shown in FIG. 18 intended to enhance the safety and reliability of the vehicle itself as in the conventional automobile mentioned above, as means against trouble of control unit of engine or the like in the vehicle, two microcomputers usually controlling the control objects monitor mutually for abnormality, and if one becomes abnormal, its abnormality is detected by the other to notify the driver promptly. Thus, in the vehicle in which the safety is very important, the reliability of the vehicle itself is enhanced, but it has not been sufficient for enhancing the reliability of the emergency informing terminal itself as the means for informing outside of abnormality such as emergency case of accident or sickness in the mobile body. That is, in the transmitter of the conventional emergency informing system, if the main control means becomes abnormal, the user does not know the abnormality at this moment, but recognizes the abnormality only when the emergency informing system fails to operate at the moment of emergency, and it is inconvenient because the emergency informing system cannot be used in case of emergency.

Further, in the conventional emergency informing terminal, the operation is realized by the power supply from the existing main battery in the vehicle, and if the main battery is broken due to traffic accident or the like and power supply from the main battery is interrupted, the operation is realized by changing over to the power supply from the auxiliary battery incorporated in the emergency informing terminal.

The power supply from the auxiliary battery is controlled by the power control device provided in the conventional emergency informing terminal, and this power control device monitors the supply voltage of the main battery, and when detecting voltage drop, it is controlled to change over to power supply from the auxiliary battery. Further, the power control device monitors the supply voltage of the auxiliary battery, and when the voltage of the auxiliary battery is lowered below a prescribed value, the abnormality of the auxiliary battery is noticed to the user.

In the conventional emergency informing terminal, however, in the auxiliary battery, in case of abnormality such as short circuit of supply source and GND, only the abnormality is noticed to the user due to voltage drop, and the problem of heat generation by such short circuit is not solved. If the auxiliary battery is short-circuited, there was a problem of damage on the emergency informing terminal due to heat generation.

SUMMARY OF THE INVENTION

The invention is devised in the light of such conventional problems, and the emergency informing terminal of the invention mounted on a vehicle or other mobile body, for making an emergency call notifying process by radio communication to the center for supervising the emergency informing system comprises a main controller for controlling the emergency informing terminal, and a sub controller for controlling communication with an external device mounted on the mobile body.

In the emergency informing terminal, the main controller monitors the operation of the sub controller, and the sub controller monitors the operation of the main controller.

In such constitution, the main controller and sub controller usually controlling the individual control objects can monitor mutually for abnormal operation each other while controlling as usual, and if one fails, the other can detect its abnormality, and the abnormality can be notified to the user, and history of abnormality can be recorded.

Further, the emergency informing terminal of the invention is an emergency informing terminal mounted on a vehicle, and capable of continuing the emergency call notifying process securely by changing over the power supply from the main battery of the mobile body to the power supply from the auxiliary battery, and the auxiliary battery comprises means for cutting off power supply to the emergency informing terminal if abnormality occurs in the power source.

DESCRIPTION OF THE PREFERRED EMBODIMENTS

Figure 1:
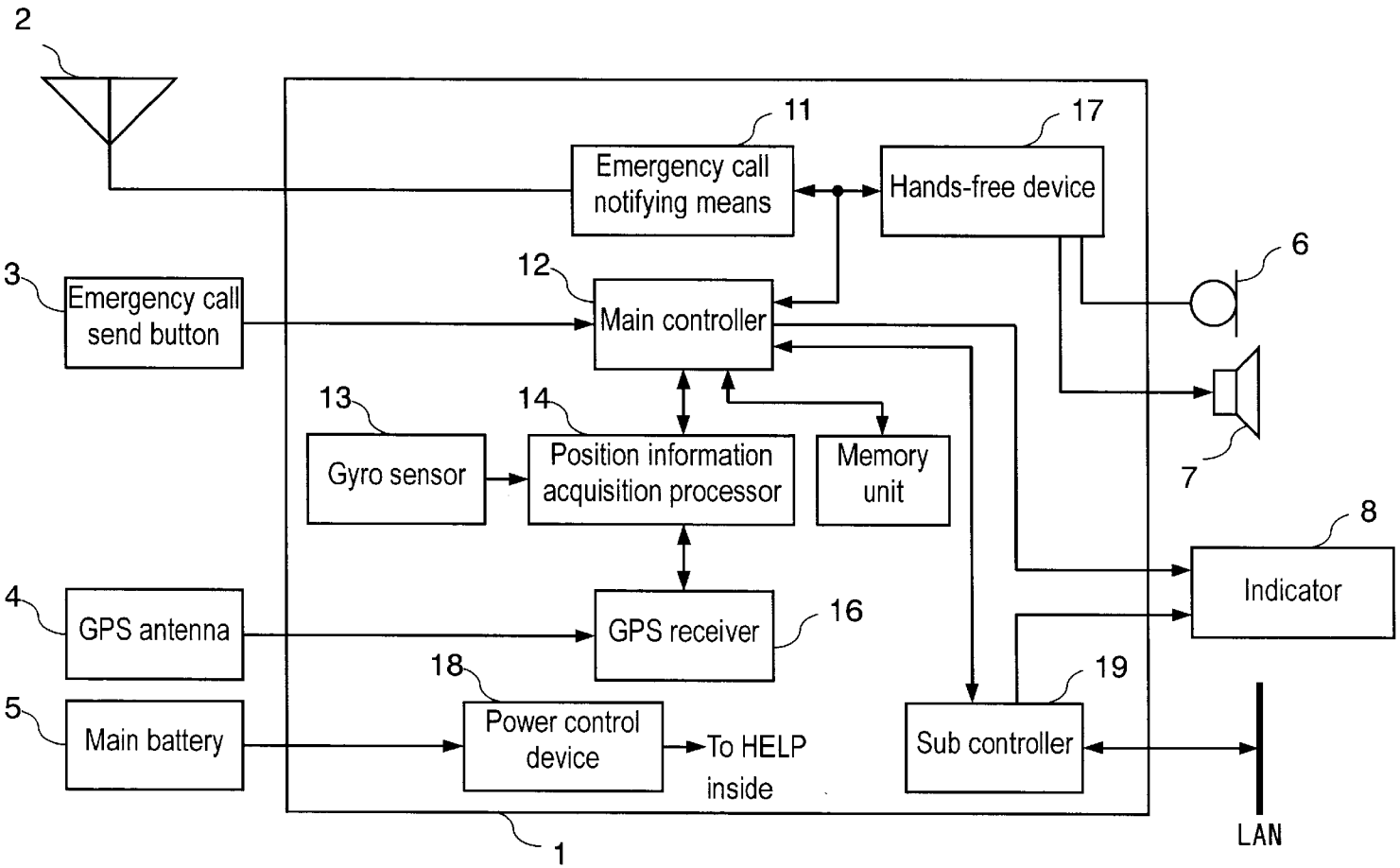
FIG. 1 is a block diagram showing a configuration of emergency informing terminal in embodiment 1 of the invention.

Referring now to the drawings, preferred embodiments of the invention are specifically described below.

(Embodiment 1)

An emergency informing terminal in embodiment 1 of the invention comprises a main controller for controlling the entire emergency informing terminal, and a sub controller for controlling communications with an external device installed in a mobile body such as car-mount local area network (LAN), in which the main controller and sub controller monitor each other, and when abnormality is detected, it is notified to the user according to the control processing function.

FIG. 1 is a block diagram showing a configuration of emergency informing terminal in embodiment 1 of the invention. In FIG. 1, the emergency informing terminal 1 is mounted on an automobile or other mobile body, and requests dispatch of emergency vehicle by transmitting the present position information of the vehicle, vehicle registration information and other data to the center for supervising the emergency informing system such as police or emergency call center (hereinafter called the center) in case of emergency such as traffic accident or sickness. A communication antenna 2 sends a transmission signal from emergency call notifying means 11 to a base station of the communications operator, and issues a reception signal from the communications operator to the emergency call notifying means 11. An emergency call send button 3 is pressed by the user in case of emergency such as traffic accident or sickness, and generates a signal for starting processing of emergency call transmission. A GPS antenna 4 is an antenna for receiving data from a GPS satellite. A main battery 5 supplies power to the electric appliances in the vehicle, and also supplies power to the emergency informing terminal 1. A microphone 6 is a microphone module incorporating a microphone for sending the user's voice to the emergency informing terminal 1 when notifying voice talk of emergency call notifying process, and an amplifying circuit and others. A speaker 7 amplifies the sound of a reception voice signal from the center when notifying the voice talk. An indicator 8 informs the user of the operating state of the emergency informing terminal 1 by using a lighting device.

In the emergency informing terminal 1, the emergency call notifying means 11, receiving a call request signal from a main controller 12, starts telephone call process to the partner corresponding to the telephone number, according to the telephone number entered from the main controller 12, through the base station of the communications operator. When receiving response from the partner or a signal transferring to talk such as busy signal, the operation is transferred to the voice talk control or data communication control, and a signal notifying transfer to talk is issued to the main controller 12. The vehicle running direction, position information and other data entered from the main controller 12 are transmitted to the center or the partner corresponding to the telephone number through the base station of the communications operator or the like.

The main controller 12, including a microcomputer, controls to record the data such as position information acquired from a position information acquisition processor 14 in a memory unit 15, controls the entire emergency informing terminal 1, monitors the operation of a sub controller 19, and informs the user of abnormality, if occurring, by using the indicator 8 or the like. If necessary, it may be informed by acoustic or synthesized voice means. Further, by an operation signal from the emergency call send button 3, an emergency call request is recognized, and to start emergency call notifying process, the data of position information or the like acquired from the position information acquisition processor 14 and recorded in the memory unit 15 are entered. The telephone number of the center is obtained from the memory unit 15. Using this telephone number, a telephone call is requested to the emergency call notifying means 11. Further, from the emergency call notifying means 11, when a response signal from the partner corresponding to the telephone number or a signal transferring to talk such as busy signal is received, transfer to talk state is recognized. Moreover, a signal for transmitting the position information history data obtained from the position information acquisition processor 14 to the center or the partner corresponding to the telephone number is issued to the emergency call notifying means 11, through the base station of the communications operator or the like.

A gyro sensor 13 is means for generating information of vehicle running direction or the like. The position information acquisition processor 14 issues the data from the gyro sensor 13, and the position information and other data generated from the data received from the GPS antenna 4 by a GPS receiver 16, to the main controller 12. The memory unit 15 records the center telephone number, the registration number of the vehicle mounting the emergency informing terminal 1, position information generated in the position information acquisition processor 14 and other information, and issues the recorded data according to a request signal from the main controller 12. The GPS receiver 16 issues the position information and other data to the position information acquisition processor 14, according to the data obtained from the GPS antenna 4. A hands-free device 17 realizes hands-free voice talk in case of emergency call notifying process by signal processing and level adjusting function, so that the transmission voice signal from the user in voice talk and the voice signal of the reception voice signal from the center may be processed by echo canceling and howling preventing process.

A power control device 18 is a power source circuit for supplying power to an internal circuit of the emergency informing terminal 1. A sub controller 19 controls communication of LAN by microcomputer or the like, and issues the reception signal from LAN or other external device to the main controller 12, either directly or by converting into a desired signal format. Further, monitoring the output signal from the main controller 12, when abnormality of the main controller 12 is detected, occurrence of abnormality is informed to the user by means of the indicator 8 or the like.

In the emergency informing terminal in embodiment 1 of the invention having such configuration, the operation is explained below. In FIG. 1, the position information acquisition processor 14 generates position information data, by using the data from the gyro sensor 13 and the data received in the GPS receiver 16 from the GPS antenna 4. The main controller 12 periodically acquires position information and other data from the position information acquisition processor 14, and records in the memory unit 15.

The user presses the emergency call send button 3 in case of emergency such as traffic accident or sickness. When pressed, the emergency call send button 3 issues a corresponding signal to the main controller 12. The main controller 12 recognizes the emergency call send request by the operation signal from the emergency call send button 3, and starts emergency call notifying process.

In the sub controller 19, when receiving a signal requesting automatic emergency call notifying process such as air bag expansion signal from the LAN, by sending a signal requesting emergency call notifying process to the main controller 12, too, the main controller 12 starts emergency call notifying process.

Once emergency call notifying process is started, the main controller 12 acquires the position information, center telephone number and other data stored in the memory unit 15, and requests telephone call to the emergency call notifying means 11 by using the telephone number. Using the communication antenna 2, the emergency call notifying means 11 starts telephone call process to the partner corresponding to the telephone number through the base station of the communications operator or the like.

The emergency call notifying means 11, when receiving response from the partner or a signal transferring to talk such as busy signal, recognizes transfer to talk state, and transfers to the voice talk control or data communication control, and issues a signal telling transfer to talk to the main controller 12. The main controller 12, judging talk is successful, transmits the data such as position information to the center of the partner corresponding to the telephone number through the base station of the communications operator or the like. The data to be transmitted includes the present position information of vehicle, running history information, terminal ID, vehicle number, registered person name, etc.

At the center, when receiving all position information data from the emergency informing terminal 1, the mode is changed to voice talk. The emergency call notifying means 11 incorporated in the emergency informing terminal 1 receives a signal telling transfer to voice talk, and issues a signal telling transfer to voice talk to the main controller 12. The main controller 12 receives the signal telling transfer to voice talk, and controls to connect the voice path of the emergency call notifying means 11 and hands-free device 17, and transfers to the voice talk notifying process.

In voice talk notifying process, the emergency call notifying means 11 issues the reception voice signal from the center to the hands-free device 17. The hands-free device 17, using the signal processing circuit, acquires the voice level and frequency characteristic from the reception voice signal, and raises the voice level of the reception voice signal, and issues to the speaker 7. The speaker 7 amplifies the sound of the reception voice signal entered from the hands-free device 17 to tell the user.

The microphone 6 acquires the voice signal from the user and the reception voice signal pronounced from the speaker 7, and issues to the hands-free device 17. The hands-free device 17, when receiving a transmission signal having similar signal component as the voice level and frequency characteristic acquired from the reception voice signal, judges to be echo component of the reception voice signal entered from the microphone 6, and eliminates the echo component, and issues to the emergency call notifying means 11. The emergency call notifying means 11 receives the transmission voice signal from the hands-free device 17, and transmits to the center.

The main controller 12 and sub controller 19 mutually communicate periodically, and monitor the operation each other by periodically continuing the mutual operation checking, using periodically changing signal such as serial signal or clock waveform as periodic communication signal. If the main controller 12 fails to send normal signal due to abnormality, that is, if the periodic communication signal is a signal showing abnormality, other signal than normal signal or no signal is issued, the sub controller 19 detects abnormality of the main controller 12, and informs the user of abnormality by using the indicator 8 or the like. On the other hand, if the sub controller 19 fails to send normal signal due to abnormality, that is, if the periodic communication signal is a signal showing abnormality, other signal than normal signal or no signal is issued, the main controller 12 detects abnormality of the sub controller 19, and informs the user of abnormality by using the indicator 8 or the like.

The communication path of the main controller 12 and sub controller 19 is an independent path using periodically changing signal such as serial signal or clock waveform as periodic communication signal, but it may be also possible to communicate through a data bus for data communication of parts.

In such configuration, it is possible to detect abnormality of the main controller 12 for controlling the emergency informing terminal 1, or abnormality of the sub controller 19 for receiving air bag expansion signal or the like from the car-mount LAN, and the system can be verified securely, while abnormality can be securely notified to the user. That is, if either the main controller 12 or sub controller 19 in the emergency informing terminal 1 becomes abnormal, the user immediately is informed of such abnormality. Therefore it eliminates inconvenience of knowing the abnormality only in case of emergency so that it is impossible to use the emergency informing system in case of emergency. Thus, the emergency informing system enhanced in reliability and safety is presented, which further contributes to higher safety of the entire automobile or mobile body system.

(Embodiment 2)

In the emergency informing terminal in embodiment 2 of the invention, the main controller and sub controller monitor each other, and when abnormality is detected, the failure history is recorded in the memory unit, and it is informed to the user by using the LED or other indicator, and the operation of this emergency informing terminal is described below.

Figure 2:
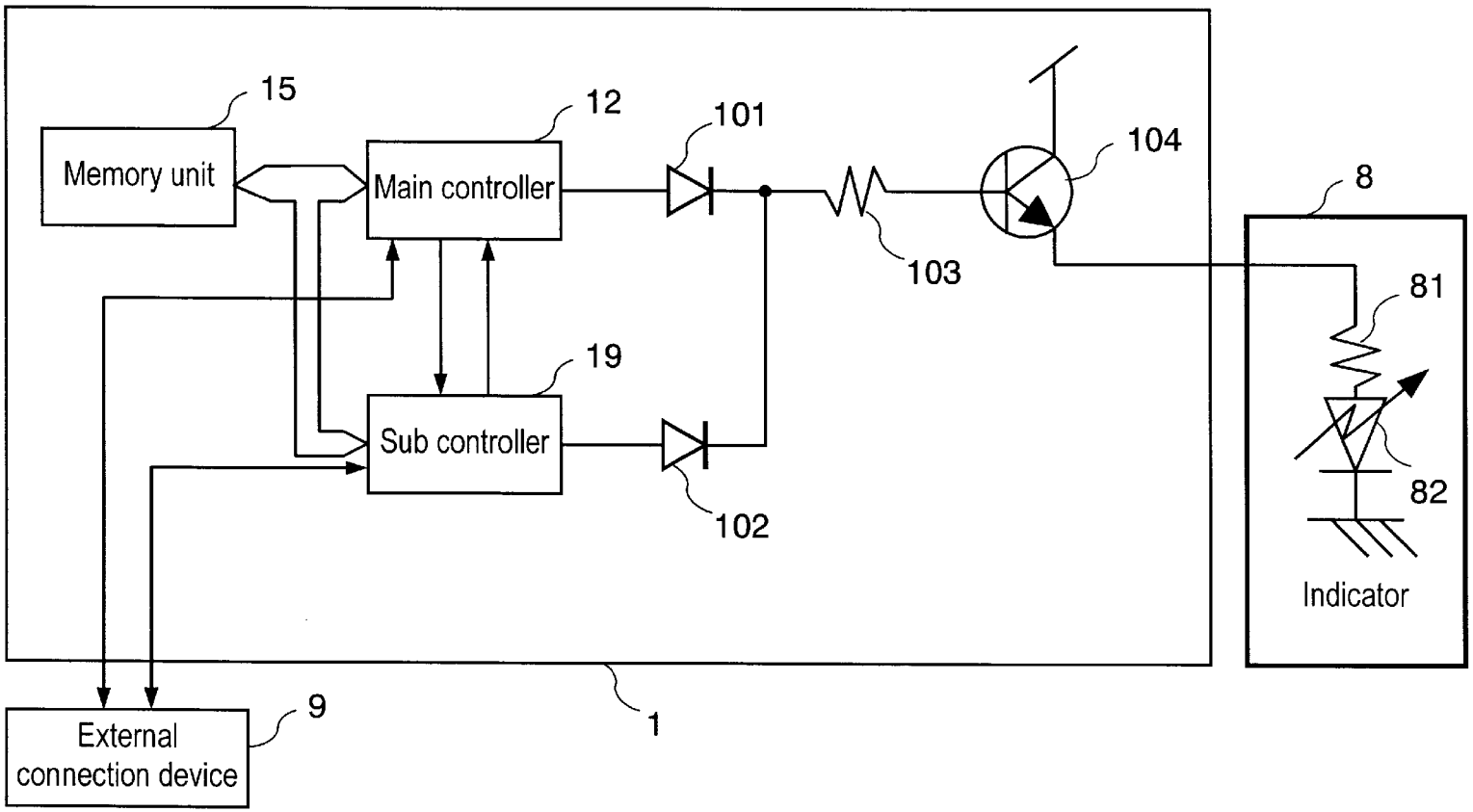
FIG. 2 is a block diagram showing a configuration of emergency informing terminal in embodiment 2 of the invention.

FIG. 2 is a block diagram showing a configuration of the emergency informing terminal in which the main controller and sub controller monitor each other, and when abnormality is detected, the failure history is recorded in the memory unit, and the LED is lit.

In FIG. 2, an emergency informing terminal 1 is an emergency informing terminal same as the emergency informing terminal 1 in FIG. 1. In the emergency informing terminal 1 shown in FIG. 2, only the blocks relating to the failure detection and user informing means are selected and shown. An indicator 8 is an indicator same as the indicator 8 in FIG. 1. A main controller 12 is a main controller same as the main controller 12 in FIG. 1. A memory unit 15 is a memory unit same as the memory unit 15 in FIG. 1. A sub controller 19 is a sub controller same as the sub controller 19 in FIG. 1. An external connection device 9 is an external connection device connected to the emergency informing terminal 1, having a function of acquiring history data from the emergency informing terminal 1 and displaying the content of the history data.

In the emergency informing terminal 1, a first diode 101 transmits a control signal from the main controller 12 to a transistor 104 for feeding power to the indicator 8. In the emergency informing terminal 1, a second diode 102 transmits a control signal from the sub controller 19 to the transistor 104 for feeding power to the indicator 8. A first resistor 103 is connected in series between the coupling point of control signals from the first diode 101 and second diode 102, and the base terminal of the transistor 104. The transistor 104 controls on/off switching of power supply to the indicator 8 by the control signals from the main controller 12 and sub controller 19. In the indicator 8, a second resistor 81 limits input of current into an LED 82. The LED 82 is a lighting device for controlling lighting by the control signals from the main controller 12 and sub controller 19.

The main controller 12 and sub controller 19 monitor each other, and when abnormality is detected, the failure history is recorded in the memory unit 15, and in the control for lighting the LED 82, the main controller 12 issues a signal showing normal operation to the sub controller 19 by periodic communication signal by serial communication system or periodically changing signal. The sub controller 19 monitors the main controller 12 by the signal from the main controller 12. The sub controller 19, if receiving other signal than normal operation signal from the main controller 12, judges abnormality, and processes to issue failure history, date and other data to the memory unit 15. The memory unit 15 records the data from the sub controller 19. Further, the sub controller 19 issues a control signal for turning on the transistor 104 through the second diode 102 and first resistor 103. By this control signal, the transistor 104 is turned on, and supplies power source to the indicator 8. This power source is supplied to the LED 82 through the second resistor 81, and the LED 82 is lit up.

Even if the sub controller 19 issues a control signal for turning on the transistor 104, the control signal can be cut off by the first diode 101 to prevent flow into the main controller 12, so that breakdown of the main controller 12 can be prevented.

Same as the main controller 12, the sub controller 19 issues a signal showing normal operation to the main controller 12 by periodic communication signal by serial communication system or periodically changing signal. The main controller 12 monitors the signal from the sub controller 19, and processes the LED lighting control same as the sub controller 19.

Incidentally, when acquiring data showing the failure date and abnormality recorded in the memory unit 15, the external connection device 9 is connected to the emergency informing terminal 1. When a data acquisition demand signal is issued from the external connection device 9, the main controller 12 and sub controller 19 acquire the data recorded in the memory unit 15, and issue to the external connection device 9. The external connection device 9, using the display unit or the like, displays the time and history data, so that the date of occurrence of abnormality and nature of abnormality will be known. Communication between the emergency informing terminal 1 and the external connection device 9 is easily realized by using serial communication signals or the like.

Figure 3:
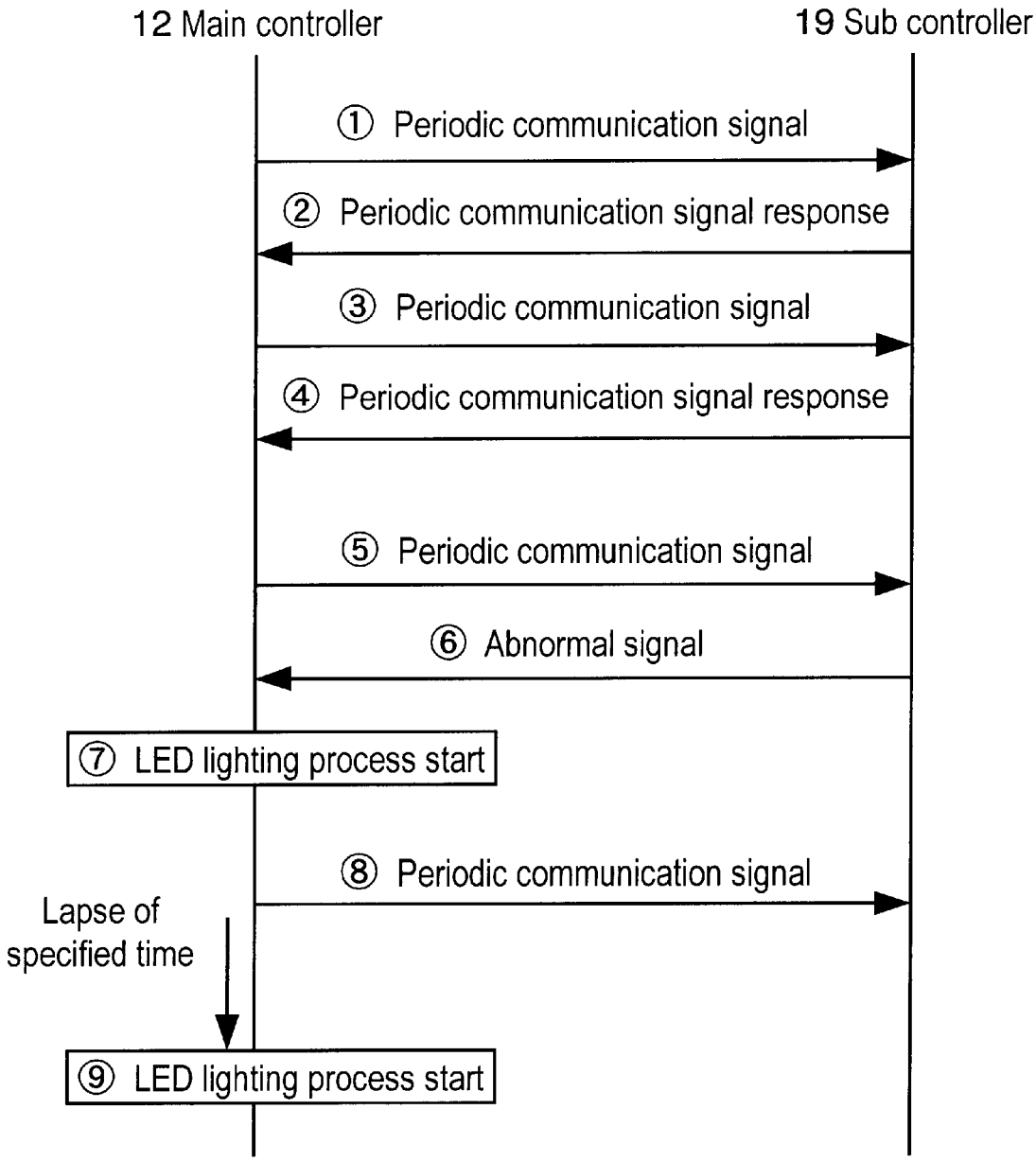
FIG. 3 is a sequence flow diagram in embodiment 2 of the invention.

FIG. 3 is a sequence flow diagram showing monitoring process by periodic communication signal by serial communication or the like. In FIG. 3, the main controller 12 issues a periodic communication signal ①, and the sub controller 19 issues a periodic communication signal response ② corresponding to the periodic communication signal ①. The main controller 12, by receiving the periodic communication signal response ②, recognizes normal operation of the sub controller 19. Further, the main controller 12 periodically issues a periodic communication signal ③, and the sub controller 19 issues a periodic communication signal response ④ corresponding to the periodic communication signal ③. The sub controller 19, when receiving a periodic communication signal within a specified time such as periodic communication signal ③, recognizes normal operation of the main controller 12.

Further, corresponding to a periodic communication signal ⑤ from the main controller 12, when a failure signal ⑥ is received from the sub controller 19, the main controller 12 judges abnormality of the sub controller 19, and transfers to the indicator lighting process and failure history recording process ⑦.

Or, corresponding to a periodic communication signal ⑧ from the main controller 12, if response signal is not received within a specified time from the sub controller 19, the main controller 12 judges abnormality of the sub controller 19, and transfers to the indicator lighting process and failure history recording process ⑨.

In FIG. 2, one indicator 8 is used for displaying abnormality of the main controller 12 and sub controller 19, but two indicators may be used.

Meanwhile, when the emergency informing terminal 1 has a device for generating an emergency call transmission condition other than emergency call send button 3 such as air bag, for example, when acquiring a status signal from an electronic control unit (ECU) mounted on the air bag through the LAN as shown in FIG. 1, and acquiring a signal showing expansion of air bag from the air bag, it is recognized that the air bag is expanded due to traffic accident, and the process goes to the emergency call notifying process. Further, by acquiring status signals periodically from the air bag, it is possible to monitor whether the air bag is normally working, or stopped in action, or abnormal due to broken wire or the like.

The sub controller 19 may also use the status signal sent periodically from the air bag as the trigger for issuing the periodic communication signal to be transmitted to the main controller 12.

Figure 4:
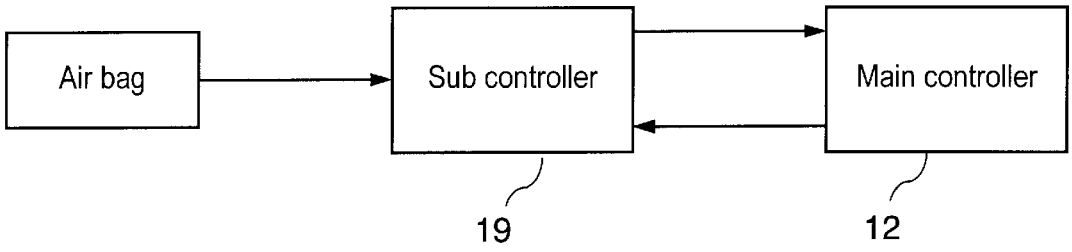
FIG. 4 is a sequence flow diagram showing monitoring process by air bag periodic communication signal among air bag, sub controller and main controller.
Figure 5:
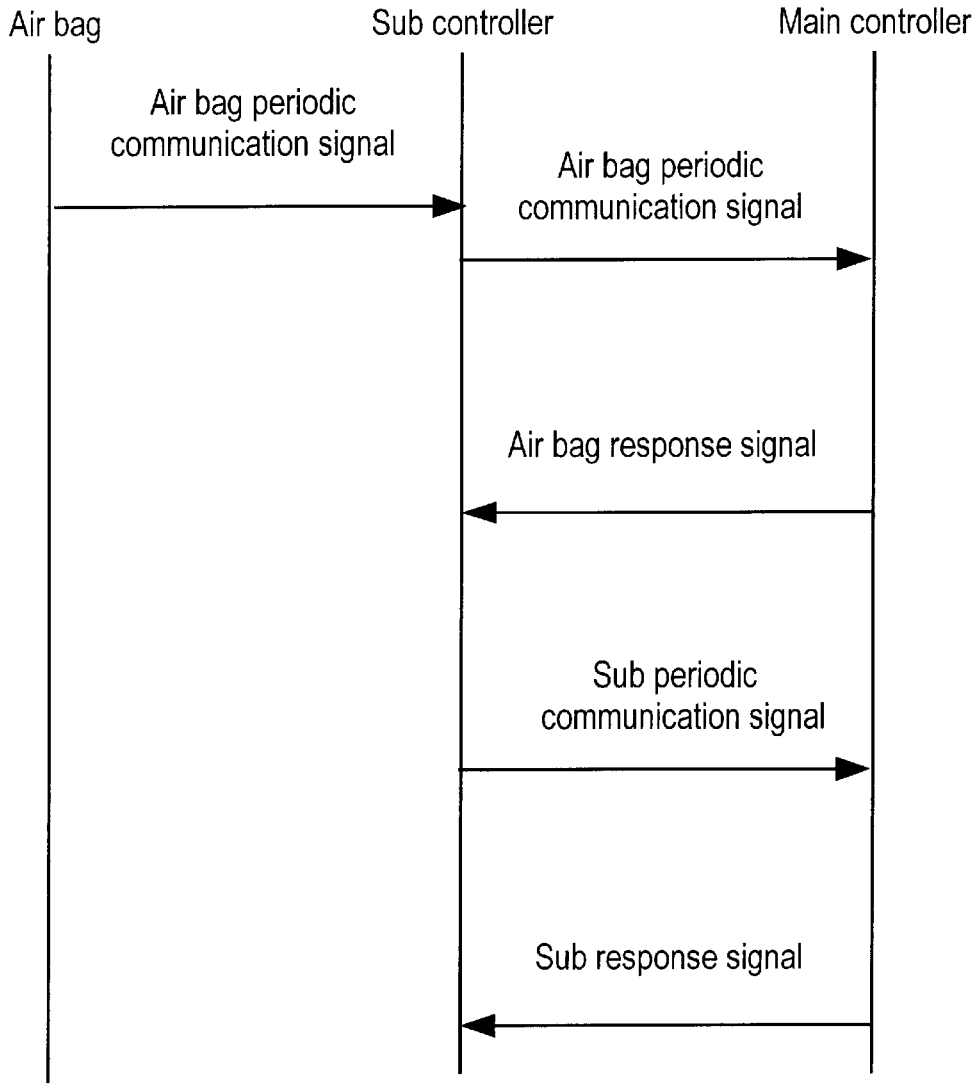
FIG. 5 is a sequence flow diagram of signals in normal state among the same devices in FIG. 4.

FIG. 4 is a sequence flow diagram showing monitoring process by air bag periodic communication signal among the air bag, sub controller 19, and main controller 12, and FIG. 5 is a diagram showing a signal sequence flow in normal state among the devices in FIG. 4.

The sub controller 19, when acquiring an air bag periodic communication signal showing normal state from the air bag, transmits an air bag periodic communication signal to the main controller 12. The main controller 12, corresponding to this air bag periodic communication signal, issues an air bag response signal. Further, the sub controller 19 issues a sub signal proving the periodic communication signal issued by the sub controller 19 itself by using the own timer or the like. As the sub controller 19 issues the periodic communication signal by itself, the main controller 12 recognizes abnormality of the sub controller 19 and the abnormality of the air bag.

Figure 6:
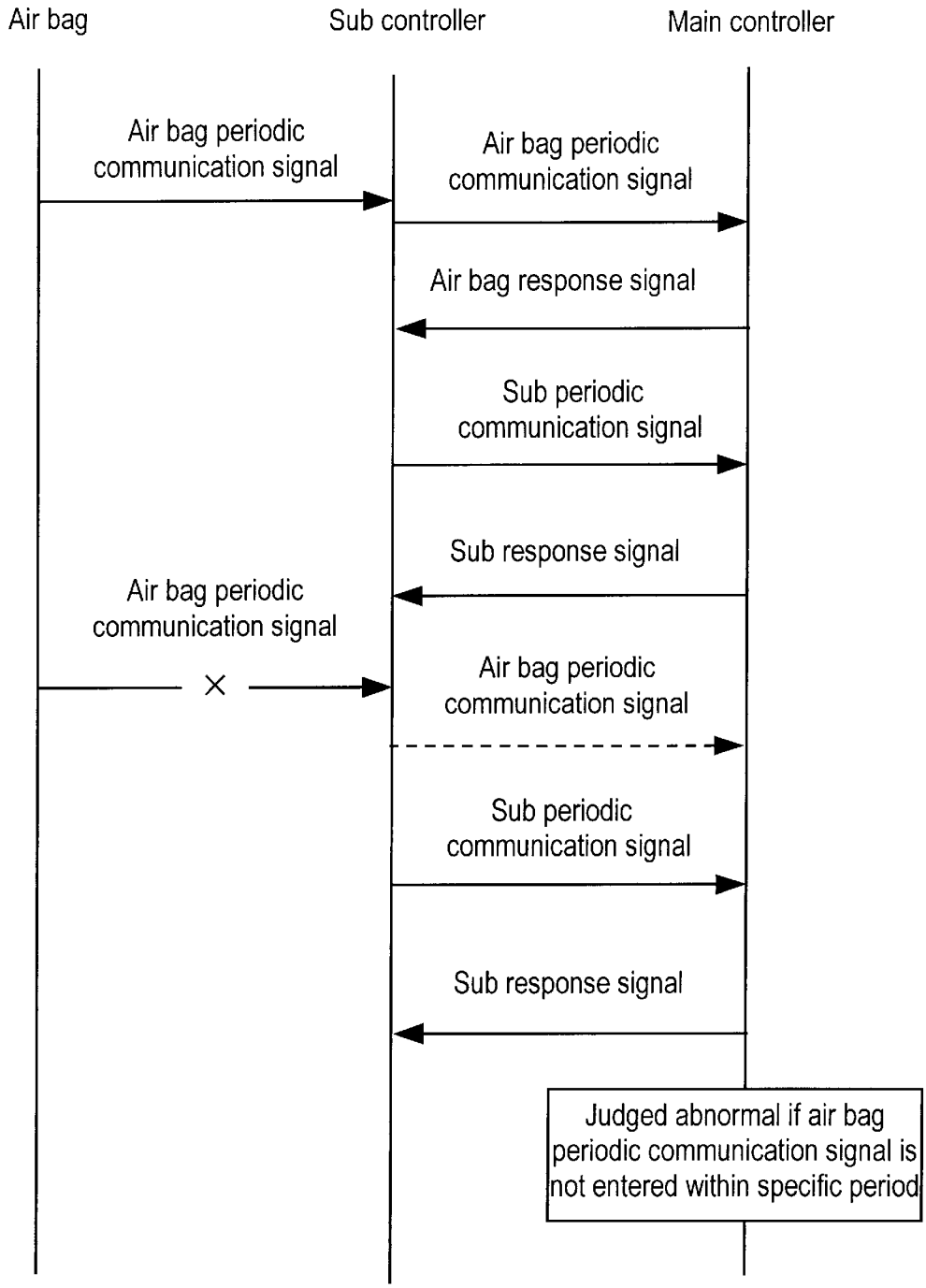
FIG. 6 is a sequence flow diagram of signals among the same devices in the event of abnormality in the air bag in FIG. 4.

FIG. 6 is a diagram showing a signal sequence flow among devices in the event of abnormality in the air bag in FIG. 4. In FIG. 6, the main controller 12 recognizes the air bag periodic communication signal acquired periodically from the air bag, and the sub periodic communication signal from the sub controller 19, and when both signals are entered within a specified time, it is judged that the operation is normal, and monitoring process continues. If the air bag periodic communication signal is not entered from the air bag within a specified time, it is judged that the air bag is abnormal, and failure notice process is executed by using the indicator 8 and others.

The main controller 12 issues, as response signals, an air bag response signal corresponding to the air bag periodic communication signal acquired from the air bag, and a sub response signal corresponding to the sub periodic communication signal from the sub controller 19, and also issues a signal distinguishing the response signal from either signal, so that the sub controller 19 can execute secure response confirmation.

Response signals may be also issued in other signal format. Using signals changing periodically, when a periodic communication signal is entered from the sub controller 19, the main controller 12 can reply by changing the signal waveform of the signal changing periodically. The sub controller 19 monitors the periodic communication signal transmitted from the main controller 12, and when recognizing change in the specified waveform within a specified period, it is judged that a response signal is received, and the monitoring operation continues. If specified waveform is not changed within a specified period, it is judged that the main controller 12 is abnormal, and failure notice process is executed by using the indicator 8 and others.

Figure 7:
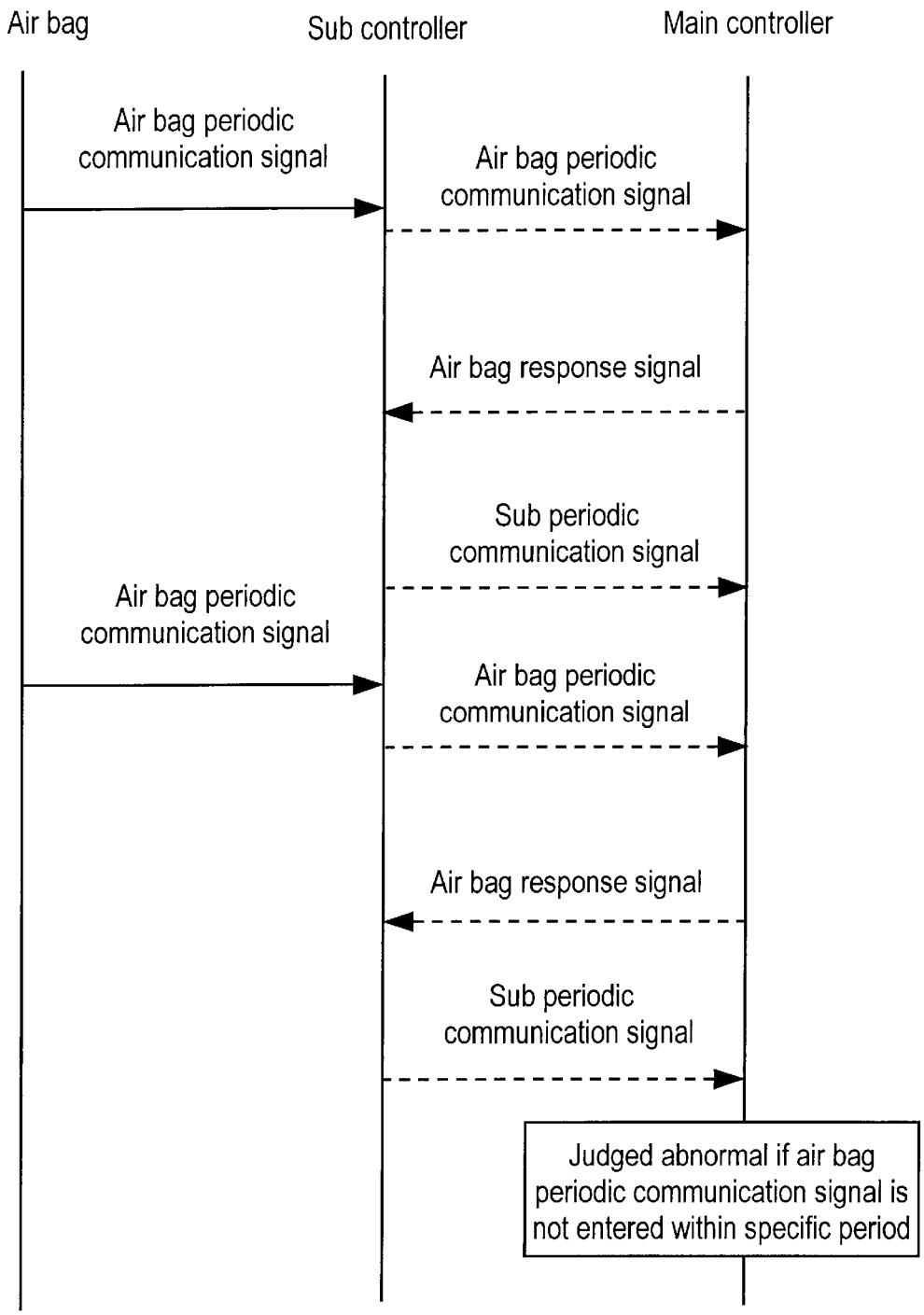
FIG. 7 is a sequence flow diagram of signals among the same devices in the event of abnormality in the sub controller in FIG. 4.

FIG. 7 is a diagram showing a signal sequence flow among devices in the event of abnormality in the sub controller in FIG. 4. In FIG. 7, the main controller 12 judges abnormality of the sub controller 19 if the signal to be acquired from the air bag and the signal to be acquired from the sub controller 19 are not entered within a specified time, and failure notice process is executed by using the indicator 8 and others.

Figure 8A:
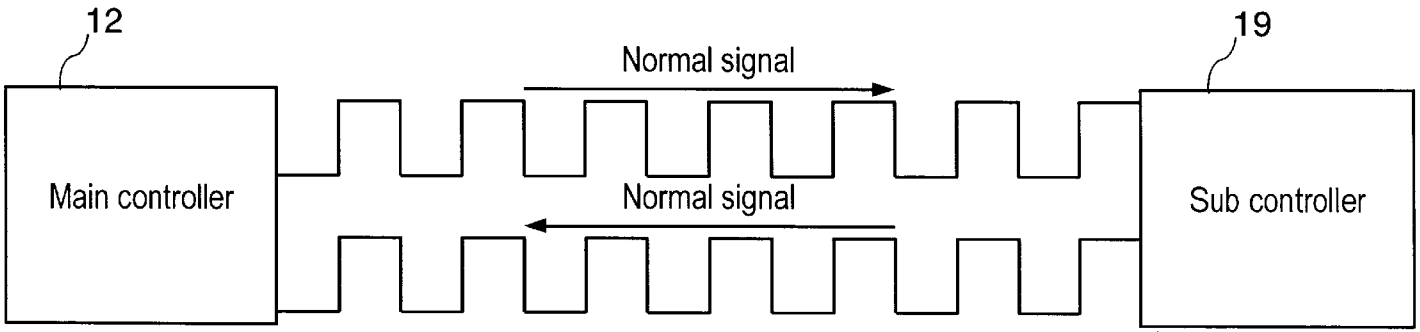
FIG. 8 is a diagram showing the signal state in the event of monitoring process in embodiment 2 of the invention.
Figure 8B:
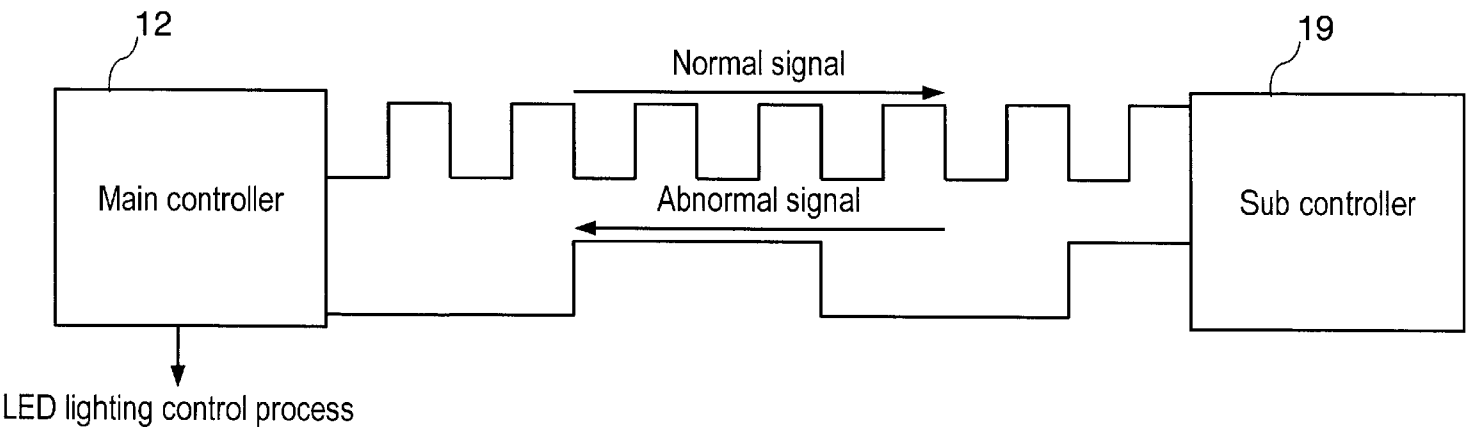

FIG. 8A and FIG. 8B are diagrams showing signal formats in the case of monitoring process by using periodically changing signals. In FIG. 8A, the main controller 12 issues a periodically changing signal. The sub controller 19, when receiving the periodically changing signal from the main controller 12, recognizes normal operation of the main controller 12. Further, the sub controller 19 issues a periodically changing signal. The main controller 12, when receiving the periodically changing signal from the sub controller 19, recognizes normal operation of the sub controller 19.

In FIG. 8B, when the main controller 12 receives a different signal from a normal signal from the sub controller 19, abnormality is judged, and the process goes to the indicator 8 lighting process and failure history recording process.

As it is explained herein, the periodically changing signal is first issued from the main controller 12, but it is the same if the periodically changing signal is first issued from the sub controller 19.

Thus, the main controller monitors periodic communication signal or periodically changing signal from the sub controller, or the sub controller monitors the same from the main controller, and when other signal than normal signal is entered, or expected signal is not entered, abnormality is judged, and the abnormality is recorded as history in the memory unit, and the abnormal state is informed to the user by using the indicator or the like. Further, by connecting an external device to the emergency informing terminal, the failure history data can be acquired and displayed, and the cause of failure can be identified, and abnormality of the emergency informing terminal can be repaired immediately.

Moreover, when the sub controller is connected to the device for generating an emergency call transmission condition such as air bag, a periodic communication signal is generated from the air bag, and it is entered in the main controller through the sub controller, so that location of abnormality can be informed to the user.

(Embodiment 3)

In the emergency informing terminal in embodiment 3 of the invention, the main controller and sub controller monitor each other, and when abnormality is detected, a reset signal is issued to the abnormal controller, and it is restored to normal operation in the following procedure.

Figure 9:
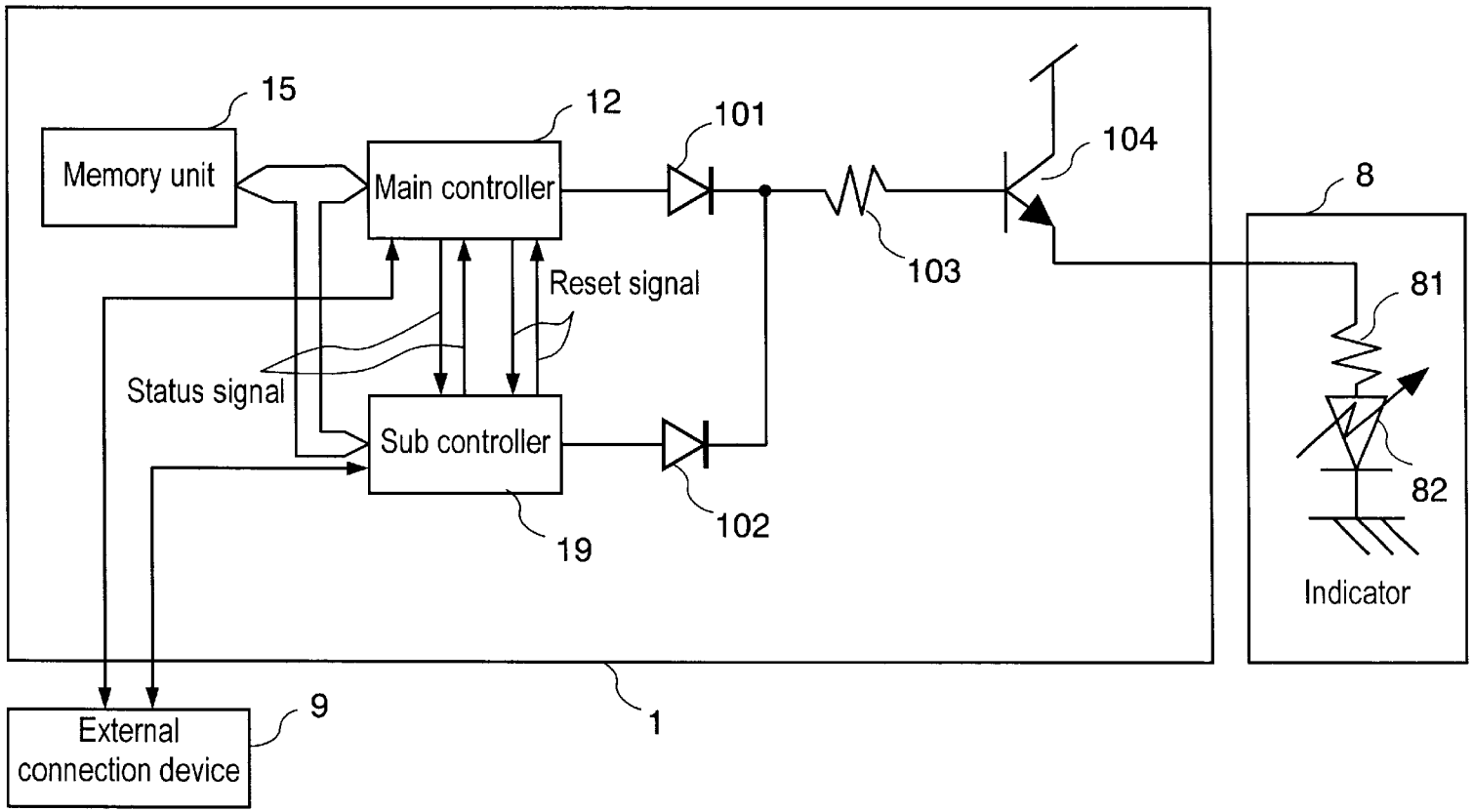
FIG. 9 is a block diagram showing a configuration of emergency informing terminal in embodiment 3 of the invention.

FIG. 9 is a block diagram showing a configuration of an emergency informing terminal for resetting in the event of detection of abnormality by mutual monitoring between the main controller and sub controller. In FIG. 9, what differs from FIG. 2 is that the main controller 12 is provided with a control signal output terminal for resetting the sub controller 19, whereas the sub controller 19 is provided with a control signal output terminal for resetting the main controller 12.

The main controller 12 is monitoring the sub controller 19 by periodic communication signal or the like, and when detecting abnormality of the sub controller 19, a reset signal is issued to the sub controller 19. Receiving the reset signal, the sub controller 19 is initialized and is restored to normal operation. However, in spite of the reset signal from the main controller 12, if the sub controller 19 is not normally restored due to its own trouble or the like, the main controller 12 judges that the sub controller 19 is abnormal, and transfers to the lighting process of LED 82 and failure history recording process into the memory unit 15.

Further, the sub controller 19 is monitoring the main controller 12 by periodic communication signal or the like, and when detecting abnormality of the main controller 12, a reset signal is issued to the main controller 12. Receiving the reset signal, the main controller 12 is initialized and is restored to normal operation. However, in spite of the reset signal from the sub controller 19, if the main controller 12 is not normally restored due to its own trouble or the like, the sub controller 19 judges that the main controller 12 is abnormal, and transfers to the lighting process of LED 82 and failure history recording process into the memory unit 15.

Thus, the main controller monitors periodic communication signal or periodically changing signal from the sub controller, or the sub controller monitors the same from the main controller, and when other signal than normal signal is entered, abnormality is judged, and by resetting process, it is restored to normal operation. If not restoring to normal operation due to trouble or the like, abnormality is judged and the abnormality is recorded as history, and the abnormality can be informed to the user by using the indicator or the like.

In this embodiment, when informing the abnormal state to the user, it is not always necessary to transmit abnormality of any one of the main controller, sub controller and air bag, but at least one indicator showing abnormal state may be provided, and abnormality of the emergency informing terminal may be notified. In the resetting process, if abnormality is detected in either controller, the both can be reset and initialized.

(Embodiment 4)

Figure 10:
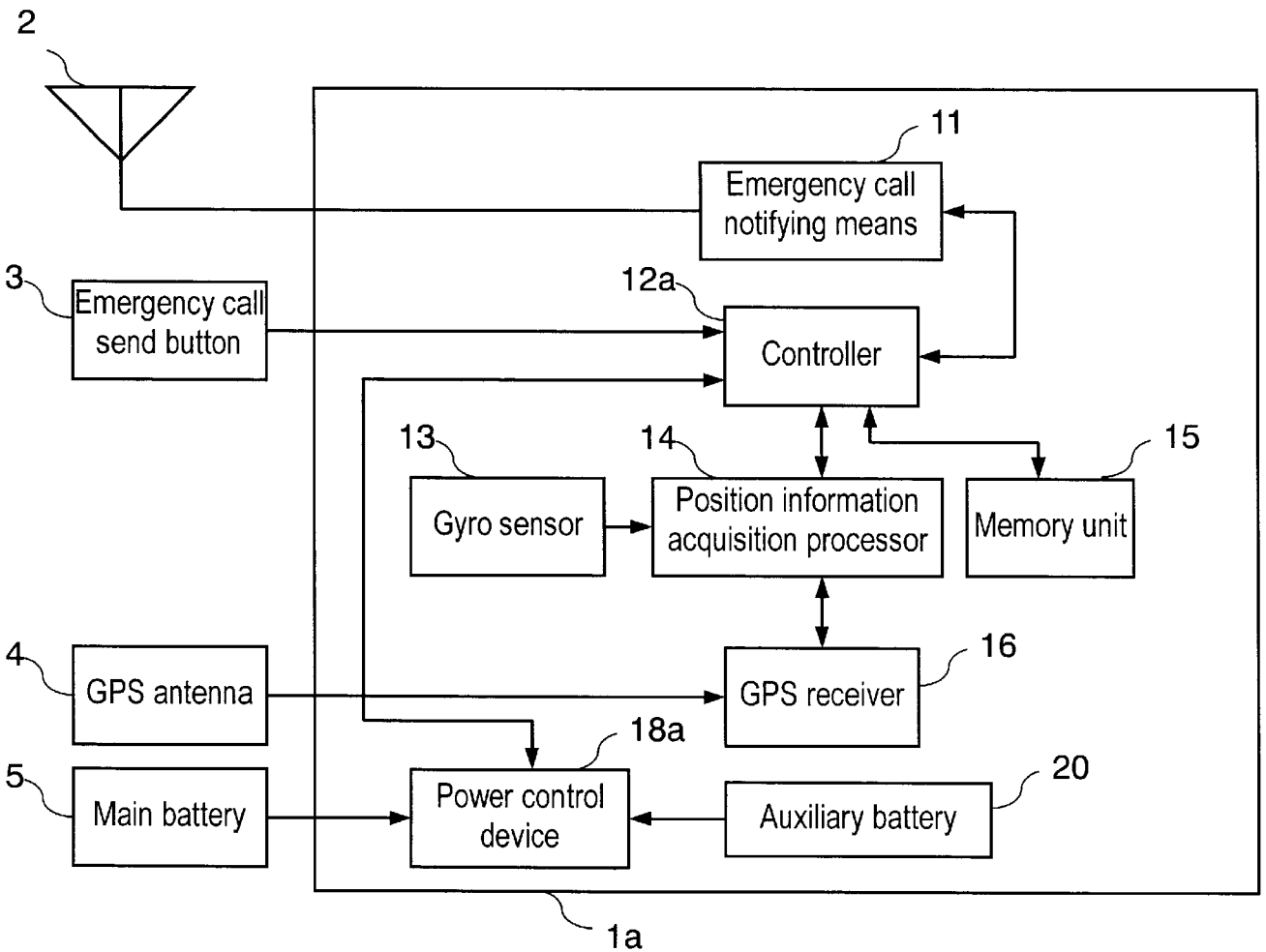
FIG. 10 is a block diagram showing a configuration of emergency informing terminal in embodiment 4 of the invention.

FIG. 10 is a block diagram showing a configuration of emergency informing terminal in embodiment 4 of the invention. In FIG. 10, an emergency informing terminal 1*a* is mounted on an automobile or other vehicle, and requests dispatch of emergency vehicle by transmitting the present position information of the vehicle, vehicle registration information and other data to the center for supervising the emergency informing system such as police or emergency call center (hereinafter called the center) in case of emergency such as traffic accident or sickness. A communication antenna 2, an emergency call send button 3, a GPS antenna 4, a main battery 5, emergency call notifying means 11, a gyro sensor 13, a position information acquisition processor 14, a memory unit 15, and a GPS receiver 16 are same as in embodiment 1 shown in FIG. 1.

A controller 12*a* is same in function as the main controller 12 in FIG. 1, but since the sub controller 19 is omitted in this embodiment, it has no function about communication or operation monitoring of the sub controller.

A power control device 18*a* monitors the supply power voltage from the main battery 5, and changes over to the power supply from an auxiliary battery 18 if the supply power voltage from the main battery 5 is lowered, and the operation of the emergency informing terminal 1 is maintained. The auxiliary battery 20 supplies power to the emergency informing terminal 1 instead of the main battery 5 if the main battery 5 is broken due to traffic accident or the like, and power supply from the main battery 5 is interrupted.

In FIG. 10, the microphone 6, speaker 7, indicator 8, and hands-free device 17 in embodiment 1 shown in FIG. 1 are omitted because they are not mentioned in the following explanation, and it may be same as the emergency informing terminal of the same configuration as shown in FIG. 1.

In the emergency informing terminal in embodiment 4 of the invention having such configuration, the operation is explained below. In FIG. 10, the position information acquisition processor 14 generates position information data, by using the data from the gyro sensor 13 and the data received in the GPS receiver 16 from the GPS antenna 4. The controller 12*a* periodically acquires position information and other data from the position information acquisition processor 14, and records in the memory unit 15.

The user presses the emergency call send button 3 in case of emergency such as traffic accident or sickness. When pressed, the emergency call send button 3 issues a corresponding signal to the controller 12*a*. The controller 12*a* recognizes the emergency call send request by the operation signal from the emergency call send button 3, and starts emergency call notifying process. The controller 12*a* acquires the position information, center telephone number and other data stored in the memory unit 15, and requests telephone call to the emergency call notifying means 11 by using the telephone number. Using the communication antenna 2, the emergency call notifying means 11 starts telephone call process to the partner corresponding to the telephone number through the base station of the communications operator or the like.

The emergency call notifying means 11, when receiving response from the partner or a signal transferring to talk such as busy signal, recognizes transfer to talk state, and transfers to the voice talk control or data communication control, and issues a signal telling transfer to talk to the controller 12*a*. The controller 12*a*, judging talk is successful, transmits the data such as position information to the center of the partner corresponding to the telephone number through the base station of the communications operator or the like.

The power control device 18*a* monitors the supply power voltage from the main battery 5, and changes over to the power supply from the auxiliary battery 20 if the supply power from the main battery 5 is interrupted due to breakage of the main battery 5 because of traffic accident or trouble, so that the operation of the emergency informing terminal 1*a* is maintained.

The auxiliary battery 20 monitors the supply voltage of the battery provided inside or the output supply voltage of the auxiliary battery 20, and if the supply voltage is lower than a specified voltage, it judges abnormality, and cuts off the power supply path. The power control device 18*a* recognizes drop of supply power voltage from the auxiliary battery 20 below a specified value, and issues a signal notifying abnormality to the controller 12, while the controller 12*a* informs the user of abnormality of the auxiliary battery 20 by using the LED or other indicator.

According to embodiment 4 of the invention, if the auxiliary battery 20 is lowered in supply voltage due to short circuit or the like, it is judged to be abnormal, and power supply is cut off, so that damage of the emergency informing terminal 1*a* due to heat generation or the like can be avoided.

(Embodiment 5)

Figure 11:
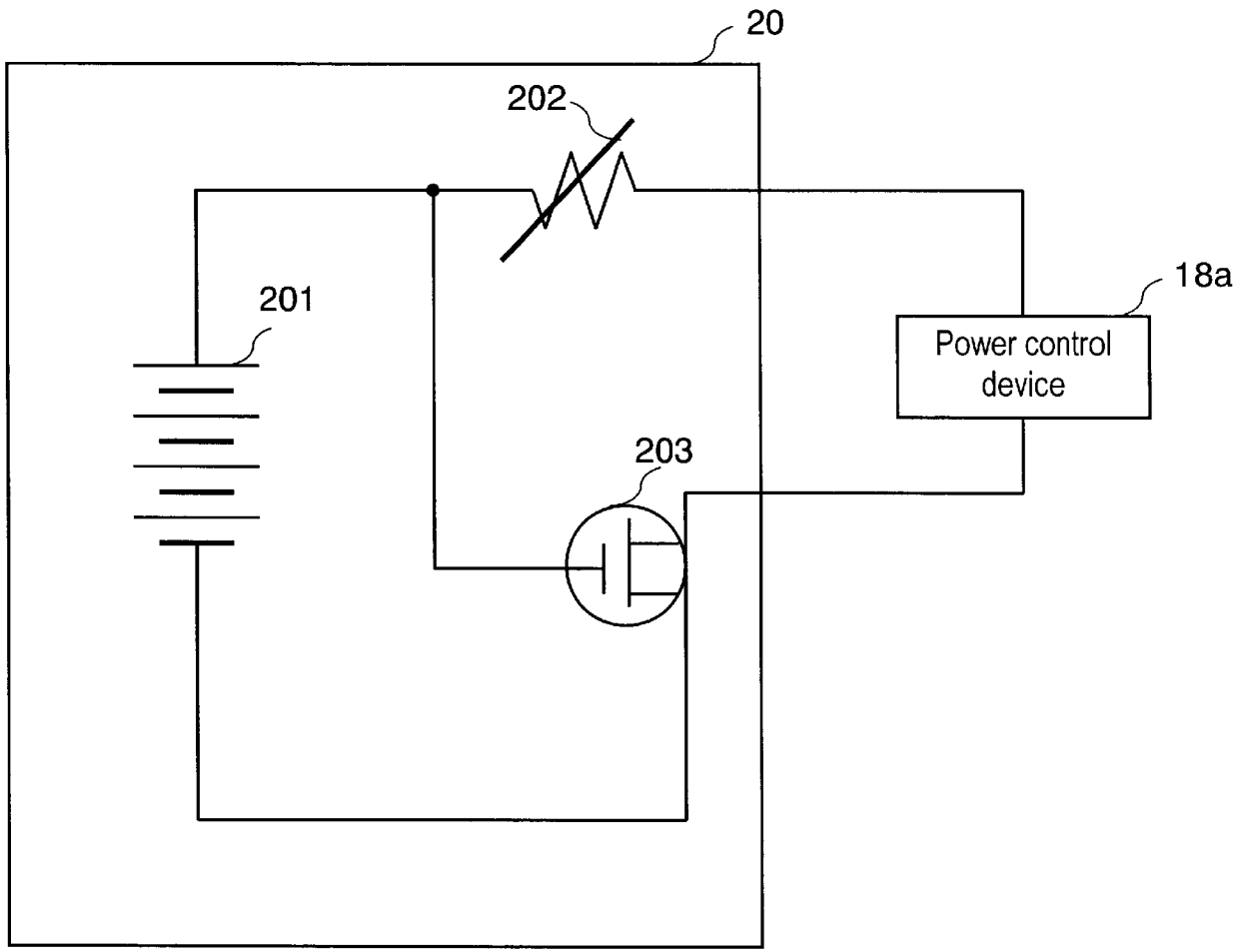
FIG. 11 is a diagram showing a configuration of auxiliary battery in embodiment 5 of the invention.

FIG. 11 shows a configuration of an auxiliary battery 20 in embodiment 5 of the invention. The auxiliary battery 20 monitors the supply voltage from the battery provided inside, and judges abnormality when the supply voltage being monitored is lowered below a specified voltage, and cuts off the power supply.

In FIG. 11, a power control device 18*a* is composed same as the power control device 18*a* in FIG. 10, and an auxiliary battery 20 is same as the auxiliary battery 20 in FIG. 10. In the auxiliary battery 20, a cell 201 such as lithium primary cell or lithium ion secondary cell supplies power to the emergency informing terminal 1*a*. An overcurrent and overheat protective element (for example, a thermistor having a positive temperature characteristic distributed in the tradename of Polyswitch by RayChem Co.) 202 generates heat when a current over a specified current flows, and functions to raise the resistance value. When it is disposed in a position where heat is generated when overcurrent flows, it is also effective to suppress the current by detecting the heat generation and raising the resistance value. Accordingly, when a current higher than a specified current flows, it is judged abnormal, and by raising the resistance value, supply of power source can be cut off. Further, an FET element 203 controls on/off switching between the drain and source by the voltage coming into the gate.

When the supply power voltage is lowered below a specified voltage, the operation of cutting off the power supply by the auxiliary battery 20 judging abnormality is explained below. The cell 201 supplies power source of a specific voltage. Through the overcurrent and overheat protective element 202, the cell 201 feeds power supply to the power control device 18*a*, and applies a supply voltage to the gate of the FET 203, thereby maintaining the FET 203 in ON state. In this case, if a current over a specified current is not flowing, the resistance value of the overcurrent and overheat protective element 202 is as close to 0 ohm as possible, and the negative electrode of the cell 201 is in conductive state by the FET 203, so that power can be supplied to the power control device 18*a*.

When the supply voltage of the cell 201 is lowered, the voltage getting into the gate of the FET 203 is lowered, and therefore the FET 203 is changed to OFF state when the supply voltage drops below a specified voltage. As the FET 203 is turned off, the power supply path linking the cell 201 and power control device 18*a* is interrupted, so that the power supply is cut off.

Thus, the auxiliary battery 20 shown in FIG. 11 includes the overcurrent and overheat protective element 202 in the power supply path, and therefore when the current is consumed more than the current usually consumed in the emergency informing terminal 1*a*, the overcurrent and overheat protective element 202 itself generates heat due to current abnormality. Since the overcurrent and overheat protective element 202 is an element having a characteristic of elevating in the resistance value when heat is generated, it suppresses power supply by elevation of resistance value. Further, the overcurrent and overheat protective element 202 has double safety effects contributing to elevation of the resistance value not only by its own heat generation but also by the heat generation portion of abnormal part becoming the heat generation source.

Figure 12:
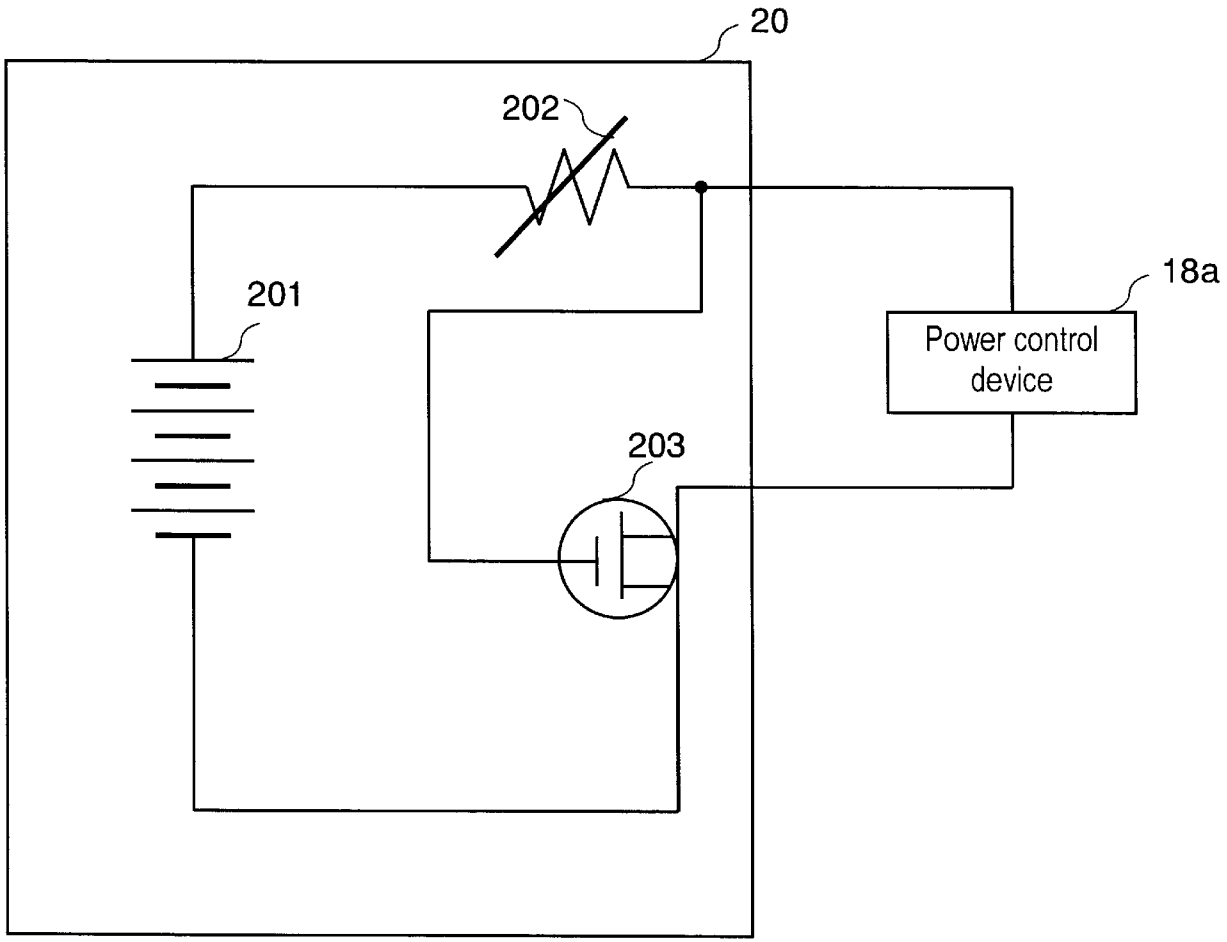
FIG. 12 is a diagram showing other configuration of auxiliary battery in embodiment 5 of the invention.

FIG. 12 shows other configuration of the auxiliary battery 20, in which the supply voltage from the auxiliary battery 20 is monitored, and when the voltage being monitored is lowered below a specific voltage, it is judged to be abnormal to cut off power supply.

By the means for monitoring supply voltage for feeding power from the auxiliary battery 20 to the power control device 18*a*, that is, by monitoring the power supply path linking the overcurrent and overheat protective element 202 and the power control device 18*a*, abnormality of power supply voltage value from the auxiliary battery 20 is detected, and abnormality is judged when lowered below a specific voltage, so that the power source can be cut off.

That is, by acquiring the input to the gate of the FET 203 from the power supply path linking the overcurrent and overheat protective element 202 and the power control device 18*a*, the voltage fed to the gate of the FET 203 is lowered by power supply suppression due to heat generation of the overcurrent and overheat protective element 202, so that the power cut-off means by both overcurrent and overheat protective element 202 and FET 203 is realized.

Thus, according to embodiment 5 of the invention, monitoring the supply power voltage from the cell 201, or the power source voltage of the supply power issued from the auxiliary battery 20, if this voltage is lowered below a specific voltage, or if a current value of the supply power changes more than specified, it is judged abnormal, and power source is cut off.

(Embodiment 6)

Figure 13:
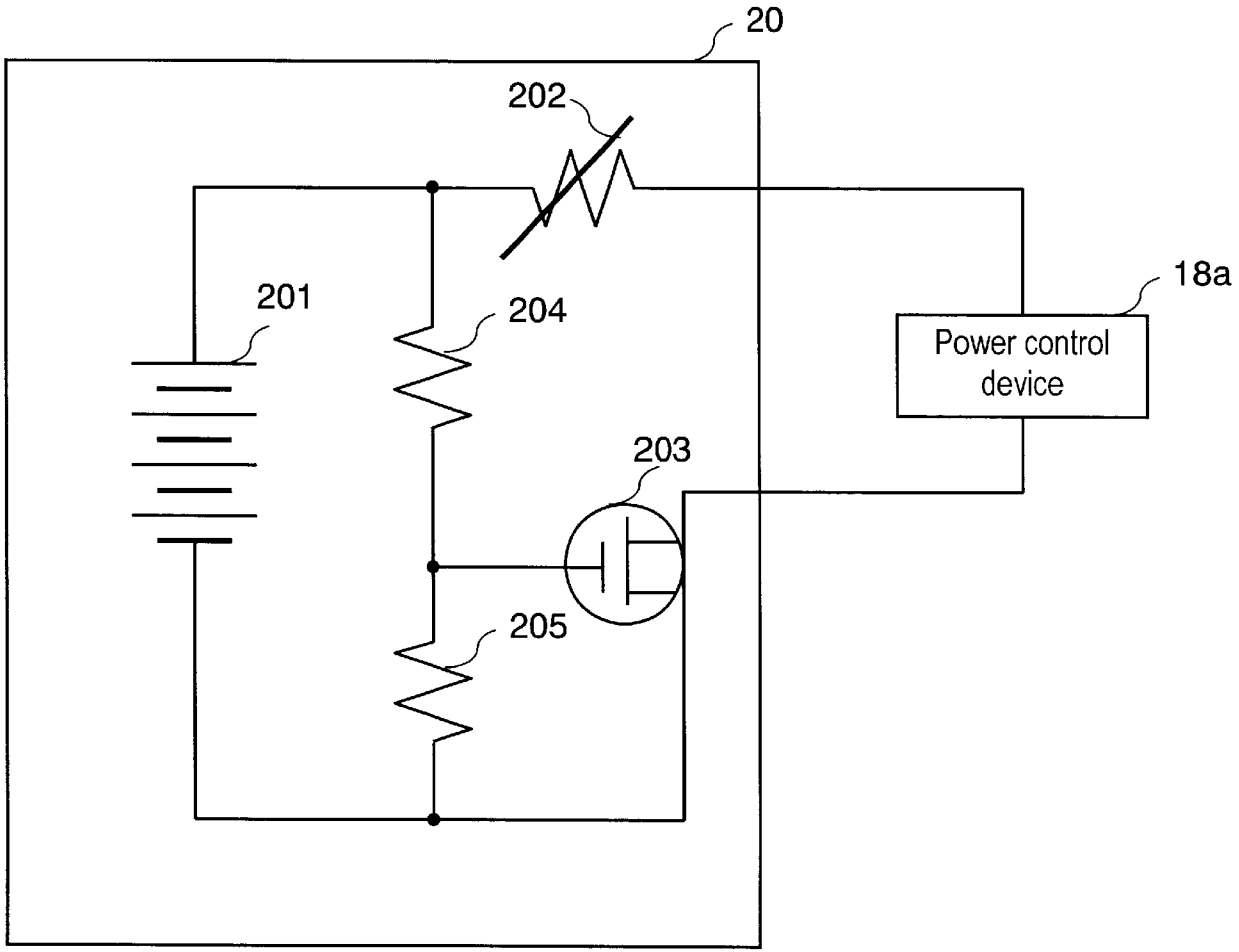
FIG. 13 is a diagram showing a configuration of auxiliary battery in embodiment 6 of the invention.

FIG. 13 shows a configuration of an auxiliary battery in embodiment 6 of the invention. The auxiliary battery 20 divides the supply voltage entering an FET 203 by using a resistor, and is designed to adjust the voltage value by the resistance dividing ratio.

In FIG. 13, a power control device 18*a* is composed same as the power control device 18*a* in FIG. 11, and an auxiliary battery 20 is same as the auxiliary battery 20 in FIG. 11. In the auxiliary battery 20 in FIG. 13, a cell 201 is same as the cell 201 in FIG. 11, an overcurrent and overheat protective element 202 is same as the overcurrent and overheat protective element 202 in FIG. 11, and further an FET 203 is same as the FET 203 shown in FIG. 11.

A resistor R1 (204) and a resistor R2 (205) are for controlling the supply voltage value entering the gate of the FET 203 by resistance division.

One end of the resistor R1 (204) is connected to the positive electrode of the cell 201, and other end of the resistor R1 (204) is connected to one end of the resistor R2 (205) and the gate of the FET 203. Further, other end of the resistor R2 (205) is connected to the negative electrode of the cell 201. In the circuit configuration as shown in FIG. 11, supposing the supply voltage from the cell 201 to be V, the resistance value of the resistor R1 (204) to be R1, and the resistance value of the resistor R2 (205) to be R2, the voltage entering the gate of the FET 203 is $\{R2/(R1+R2)\}\times V$, which is proportional to the voltage of the cell 201. Accordingly, by knowing the voltage threshold for cutting off the power supply by the FET 203, the value of the voltage for cutting off due to voltage drop of the cell 201 can be adjusted by the resistance value of the resistors R1, R2.

Figure 14:
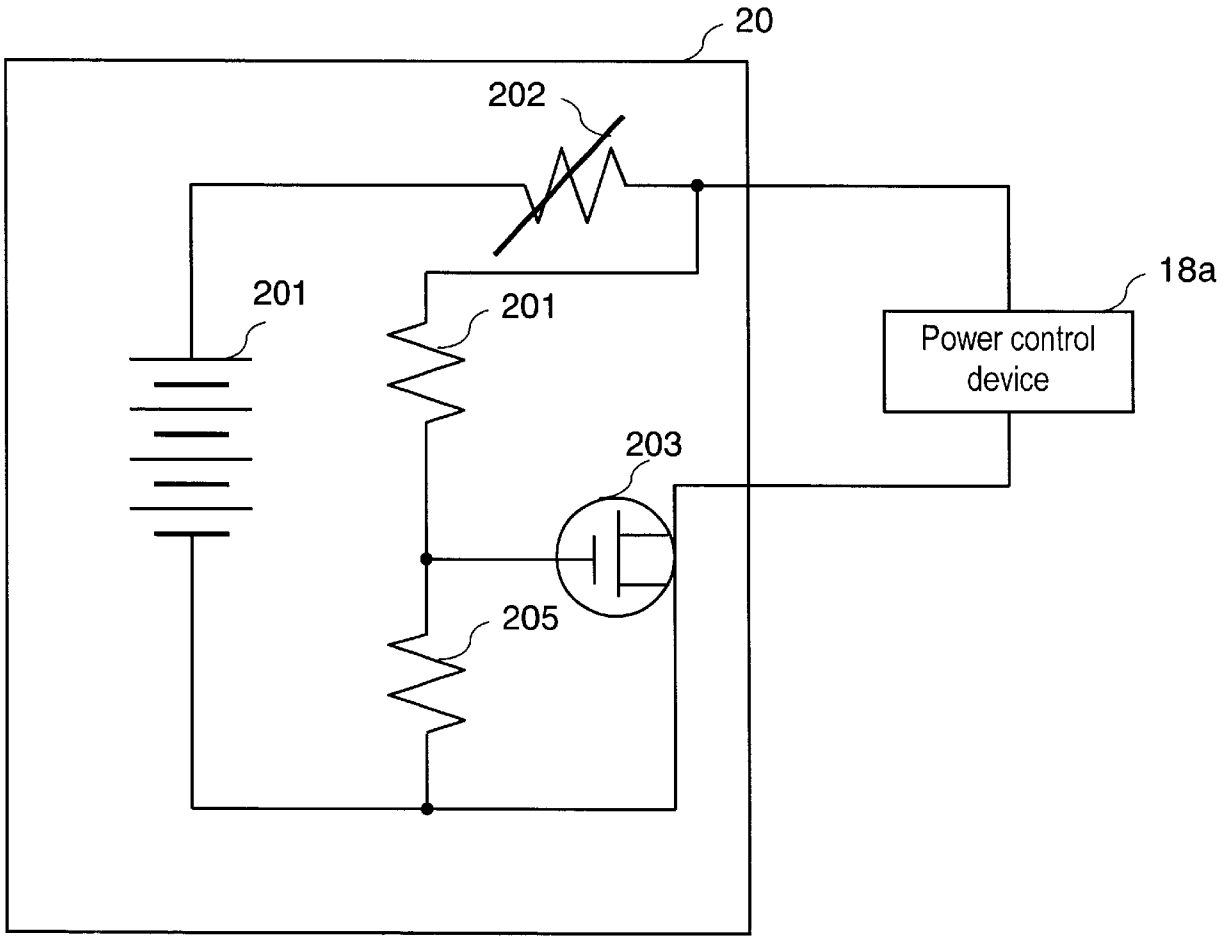
FIG. 14 is a diagram showing other configuration of auxiliary battery in embodiment 6 of the invention.

FIG. 14 shows other configuration of auxiliary battery 20, in which the supply voltage value from the auxiliary battery 20 is monitored, and it is judged abnormal when the monitored voltage drops below a specified voltage, thereby cutting off power supply.

By the means for monitoring supply voltage for feeding power from the auxiliary battery 20 to the power control device 18*a*, that is, by the means for monitoring the voltage in the power supply path linking the overcurrent and overheat protective element 202 and the power control device 18*a*, abnormality of power supply voltage value from the auxiliary battery 20 is detected, and abnormality is judged when lowered below a specific voltage, so that the power source can be cut off, and at the same time, further, by dividing the supply power voltage from the auxiliary battery 20 by the resistors R1, R2, it is possible to adjust the voltage to be cut off.

Moreover, by acquiring the input to the gate of the FET 203 from the power supply path linking the overcurrent and overheat protective element 202 and the power control device 18*a*, the voltage feed to the gate of the FET 203 is lowered by power supply suppression due to heat generation of the overcurrent and overheat protective element 202, so that the power cut-off effect by both overcurrent and overheat protective element 202 and FET 203 can be further enhanced.

Thus, according to embodiment 6 of the invention, monitoring the supply power voltage from the cell 201, or the power source voltage of the supply power issued from the auxiliary battery 20, if this voltage is lowered below a specific voltage, or if the current of power supply changes more than specified, it is judged abnormal, and power source is cut off, and also it is possible to adjust the cut-off voltage beforehand, and the supply voltage drop due to momentary power failure and the supply voltage drop due to abnormality of the auxiliary battery 20 can be distinguished so as to cut off.

Figure 15:
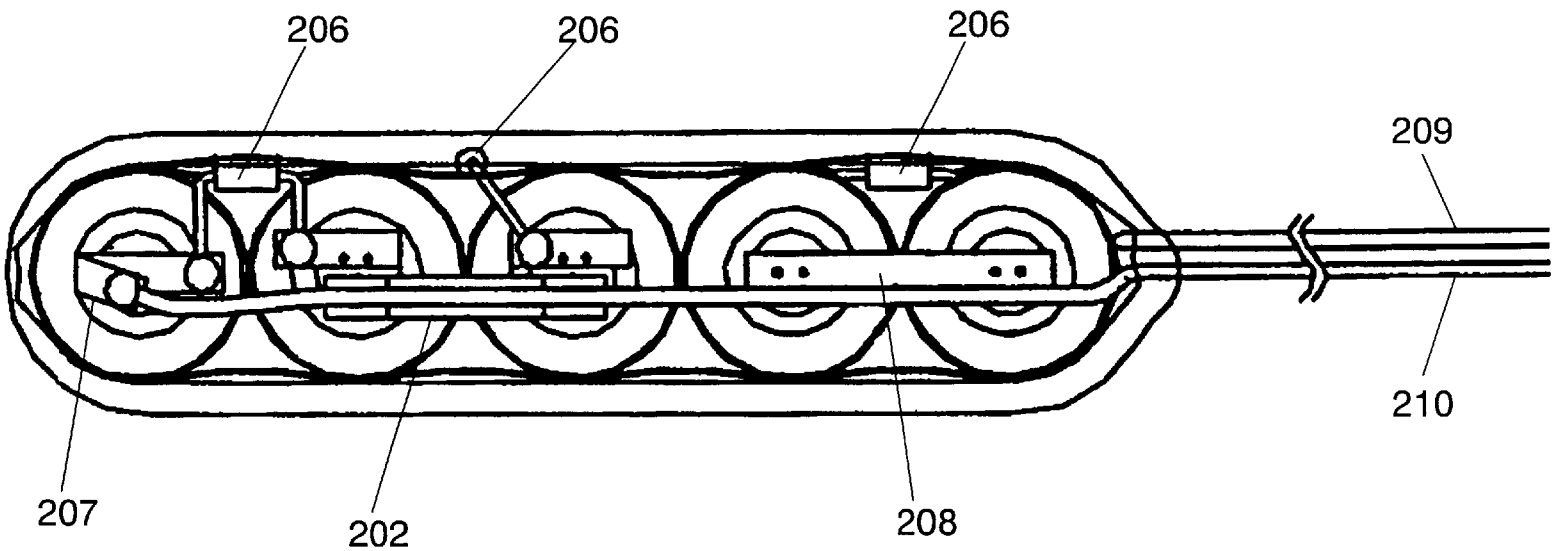
FIG. 15 is a diagram showing a mounting configuration of auxiliary battery module used in embodiment 6 of the invention.
Figure 16:
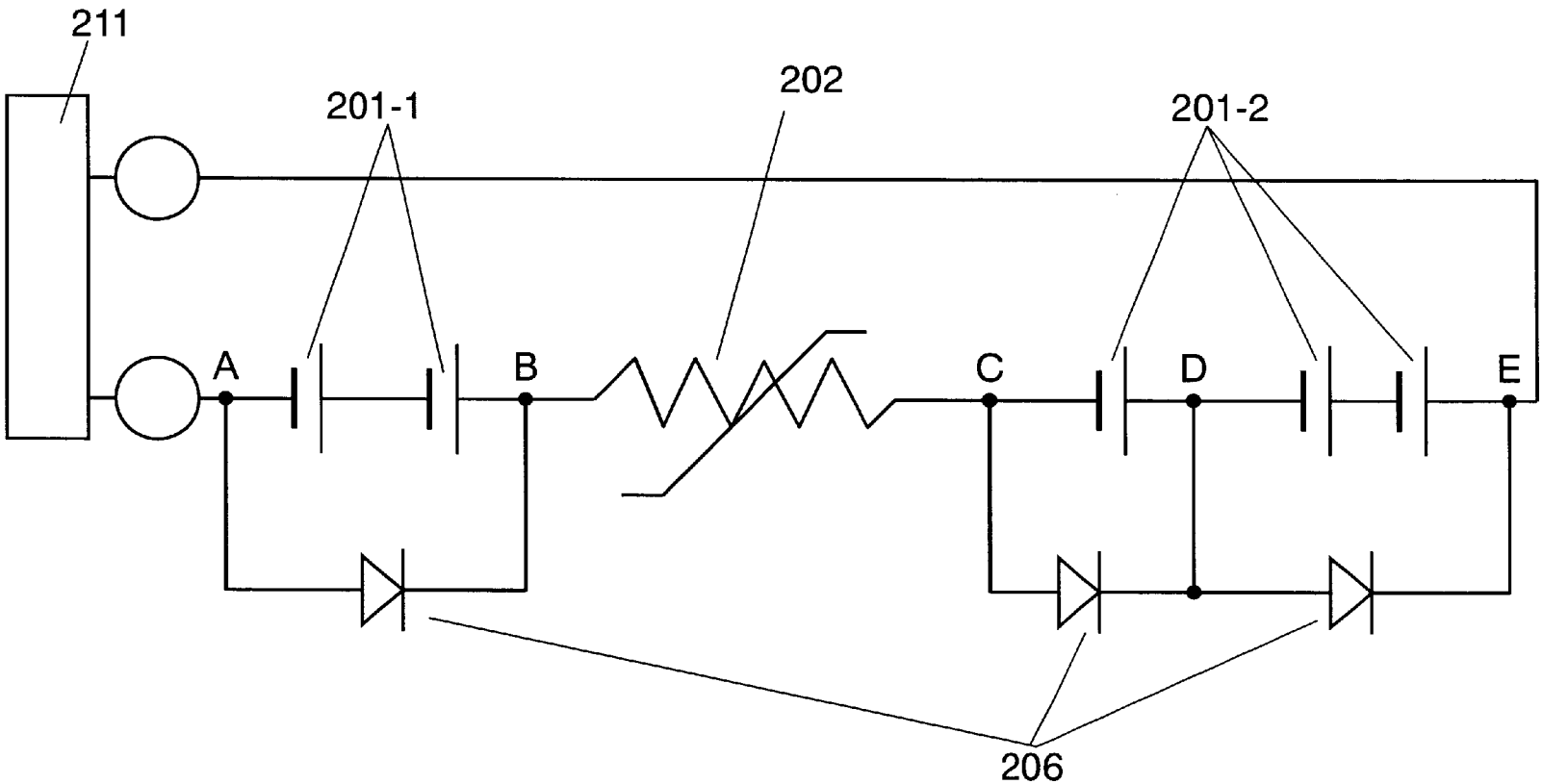
FIG. 16 is a diagram showing a circuit configuration of auxiliary battery module in FIG. 15.
Figure 17:
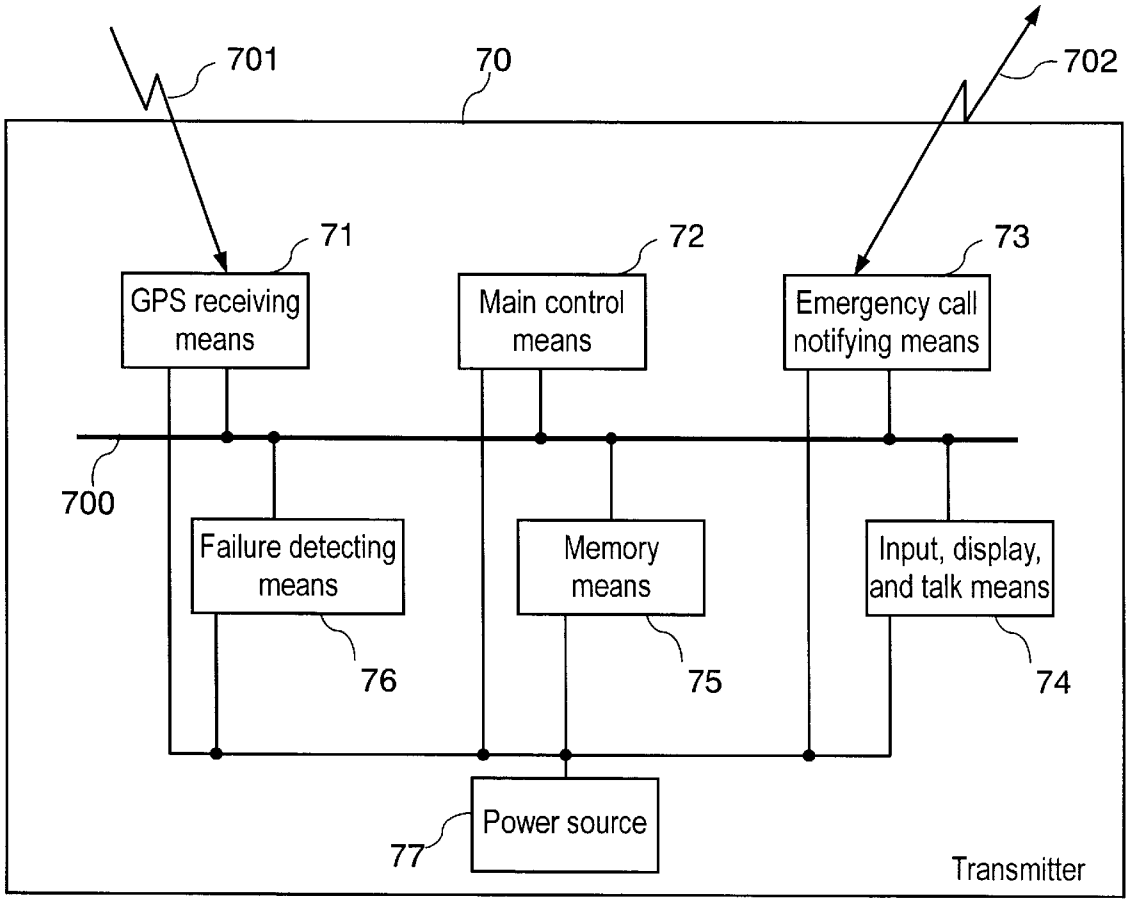
FIG. 17 is a block diagram showing a configuration of a conventional emergency informing system.
Figure 18:
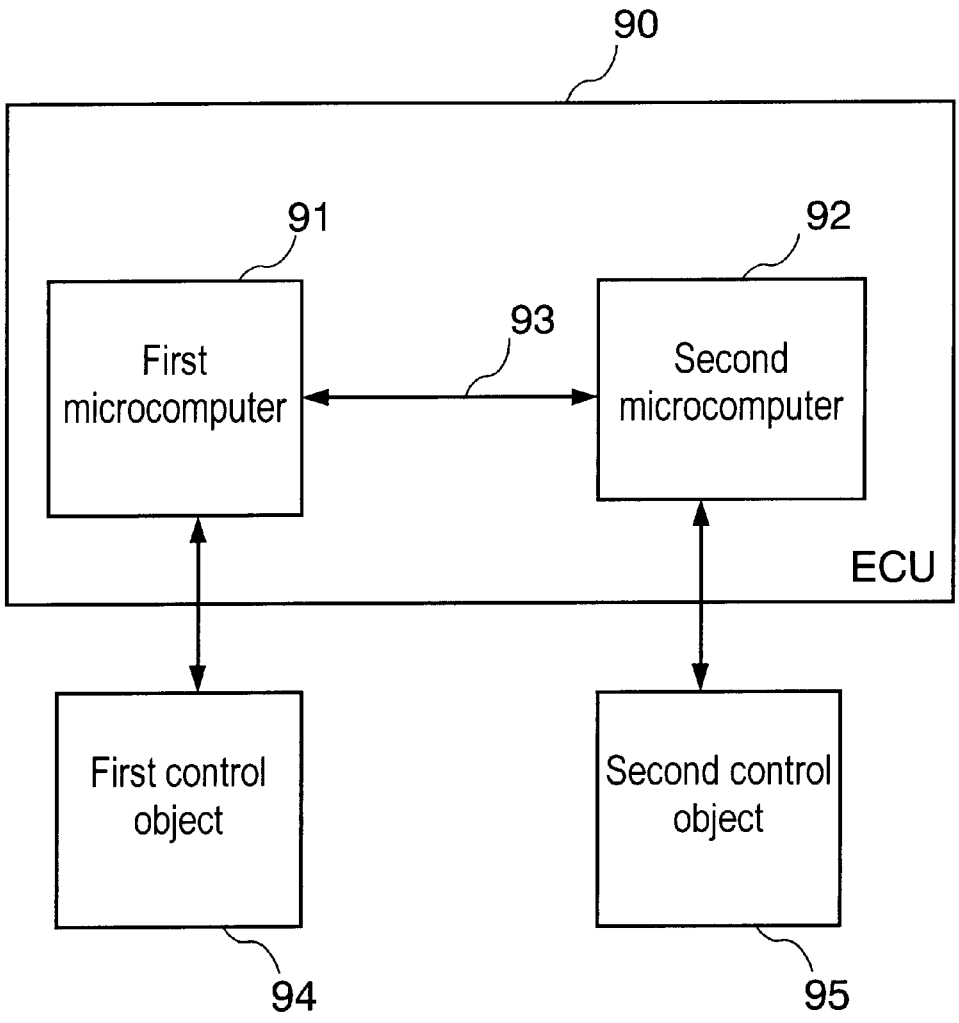
FIG. 18 is a block diagram showing an example of configuration of a conventional multi-microcomputer system.

FIG. 15 shows a mounting configuration of auxiliary battery module used in each embodiment of the invention, and FIG. 16 is a diagram showing a circuit configuration of auxiliary battery module in FIG. 15.

It is a feature of the auxiliary battery module that five cells 201-1, 201-2 for composing the lithium primary cell are inserted in series, and overcurrent and overheat protective element 202 is inserted in series as shown in the diagram. Moreover, diodes 206 are connected parallel to the cells at three positions. In FIG. 15 and FIG. 16, the number of cells connected in series for composing the lithium primary cell is 5, but this is only an example, and the number of diodes 186 to be connected parallel varies with the number of cells inserted in series for composing the lithium primary cell, and therefore it is not limited to the illustrated example alone.

In the auxiliary battery module in FIG. 15, the overcurrent and overheat protective element 202 is mounted at the middle position of the module. When detecting temperature characteristics in the module, it is possible to detect more quickly in the middle than at the ends. For connecting the cells, using connection terminals 207, plus lead wires 209 and minus lead wires 210 are drawn out, and connected to connectors 211 (see FIG. 16).

The overcurrent and overheat protective element 202 is composed of a thermistor having a positive temperature characteristic as explained in embodiment 5, having a function of raising the resistance value by generating heat when a current over a specific current flows. When the temperature of the overcurrent and overheat protective element 202 is raised due to heat generation of the cell, the resistance value of the overcurrent and overheat protective element 202 becomes higher, and it is hence effective to prevent overcurrent.

Therefore, in case the cells 201-1 close to the minus side of the connector 211 are short-circuited, a large current flows in the overcurrent and overheat protective element 202, and the overcurrent and overheat protective element 202 generates heat, and the resistances value elevates to suppress the flowing current. Or, by detecting this heat generation at the power control device side not shown, the power supply can be cut off.

Parallel connection of diodes is explained. In FIG. 16, assuming the overcurrent and overheat protective element 202 is broken due to short circuit or the like, in the case of lithium primary cell, the cells function to maintain the cell voltage of 3 V, and therefore the power source is concentrated on the cell of the lowest supply voltage, and the voltage −12 V of the four other cells, that is, (3–15) V is applied to one concentrated cell, thereby transferring to the charge state. Once the lithium primary cell is transferred to the charge state, heat generation is induced, and damage may be applied to the emergency informing terminal.

To avoid such damage, the diodes are connected parallel. That is, in FIG. 16, for example, assuming the cells between C and D to be transferred to the charge state, VDC is changed to −12 V. However, by the diode 206 connected parallel between C and D, application of minus potential is prevented, and −12 V is not applied in the cells between C and D, and heat generation can be prevented by avoiding charging. Between A and B, and between D and E, the diode 206 is inserted in every two cells in series, but as far as the potential is −3 V, although heat is generated, no damage is given, and the safety of the cells can be assured. In the shown example, the cells are connected in one series between C and D, but the position of the cells in this one series is not limited to this example, and the position may be between A and B, or between D and E in the drawing. In the illustrated example, the overcurrent and overheat protective element 202 is disposed between B and C, but not limited to this example, it may be also disposed between C and D, or at any intermediate positions avoiding the ends.

As clear from the description herein, according to the invention, the main controller is provided with a monitoring and controlling function of the sub controller, and the sub controller is provided with a monitoring and controlling function of the main controller, and therefore abnormality can be detected mutually, and if abnormality is detected by monitoring of the main controller or sub controller, it may be normally restored by resetting process, or if not restored normally due to trouble, it is judged to be abnormal, and the failure date and failure history data are recorded, and the abnormality can be informed to the user, so that the emergency informing system further enhanced in reliability and safety can be presented.

It also presents the emergency informing terminal and the emergency informing system having excellent effects contributing to further enhancement of the safety of the entire automobile or mobile body system.

Moreover, in the event of abnormality due to auxiliary battery short circuit, only by cutting off the power supply route, the short-circuited state can be transferred to the release state, and heat generation due to short circuit can be prevented, and spread of damage to the emergency informing terminal can be avoided.

The foregoing embodiments are explained by mainly referring to automobiles and vehicles, but the emergency informing terminal of the invention may be applied to all other mobile bodies on which the terminal can be mounted such as aircraft, railcar, and ship.

What is claimed is:

1. An emergency informing terminal mounted on a vehicle or other mobile body for communicating with a center for supervising an emergency informing system, comprising:

a main controller for controlling the emergency informing terminal, and a sub controller for controlling communications with an external device in the vehicle, the sub controller monitoring operation of the main controller, and the main controller monitoring operation of the sub controller, such that in the event of a problem of one of the main controller and the sub controller an indication of the problem is provided by the other of the main controller and the sub controller.

2. The emergency informing terminal of claim 1, wherein said main controller monitors the operation of said sub controller.

3. The emergency informing terminal of claim 2, wherein said main controller monitors the operation of said sub controller by monitoring periodic communication signals from said sub controller.

4. The emergency informing terminal of any one of claims 1 to 3, wherein at least one of said main controller and said sub controller has a microcomputer.

5. The emergency informing terminal of claim 3, wherein periodic communication signals from said sub controller are serial signals, and said main controller monitors the operation of said sub controller by the data on the basis of a specified format obtained from the serial signals.

6. The emergency informing terminal of claim 3, wherein periodic communication signals from said sub controller are periodically changing signals such as clock waveform, and said main controller monitors the operation of said sub controller by these periodic communication signals.

7. The emergency informing terminal of any one of claims 3, 5, and 6, wherein said main controller judges said sub controller is abnormal when periodic communication signals from said sub controller are other than normal signals or are not received.

8. The emergency informing terminal of claim 7, wherein if said sub controller is abnormal, said main controller issues a reset signal to said sub controller, and initializes said sub controller and restores the normal operation.

9. The emergency informing terminal of claim 7, wherein if said sub controller is abnormal, said main controller processes to record the abnormality of said sub controller in the history.

10. The emergency informing terminal of claim 8, wherein if said sub controller is not normally restored by the reset signal but remains abnormal, said main controller processes to record the abnormality of said sub controller in the history.

11. The emergency informing terminal of claim 9, wherein said external device acquires the history data recording the abnormality of said sub controller from the emergency informing terminal.

12. The emergency informing terminal of claim 10, wherein said external device acquires the history data recording the abnormality of said sub controller from the emergency informing terminal.

13. The emergency informing terminal of claim 7, wherein if said sub controller is abnormal, said main controller has a function of informing the user of abnormality of said sub controller.

14. The emergency informing terminal of claim 8, wherein if said sub controller is not normally restored by the reset signal but remains abnormal, said main controller has a function of informing the user of abnormality of said sub controller.

15. The emergency informing terminal of claim 13, wherein if said sub controller is not normally restored by the reset signal but remains abnormal, said main controller has a function of informing the user of abnormality of said sub controller.

16. The emergency informing terminal of claim 1, wherein said sub controller monitors the operation of said main controller.

17. The emergency informing terminal of claim 16, wherein said sub controller monitors the operation of said main controller by monitoring periodic communication signals from said main controller.

18. The emergency informing terminal of claim 17, wherein periodic communication signals from said main controller are serial signals, and said sub controller monitors the operation of said main controller by the data on the basis of a specified format obtained from the serial signals.

19. The emergency informing terminal of claim 17, wherein periodic communication signals from said main controller are periodically changing signals such as clock waveform, and said sub controller monitors the operation of said main controller by these periodic communication signals.

20. The emergency informing terminal of any one of claims 17 to 19, wherein said sub controller judges said main controller is abnormal when periodic communication signals from said main controller are other than normal signals or are not received.

21. The emergency informing terminal of claim 20, wherein if said main controller is abnormal, said sub controller issues a reset signal to said main controller, and initializes said main controller and restores the normal operation.

22. The emergency informing terminal of claim 20, wherein if said main controller is abnormal, said sub controller processes to record the abnormality of said main controller in the history.

23. The emergency informing terminal of claim 21, wherein if said main controller is not normally restored by the reset signal but remains abnormal, said sub controller processes to record the abnormality of said main controller in the history.

24. The emergency informing terminal of claim 22, wherein said external device acquires the history data recording the abnormality of said main controller from the emergency informing terminal.

25. The emergency informing terminal of claim 23, wherein said external device acquires the history data recording the abnormality of said main controller from the emergency informing terminal.

26. The emergency informing terminal of claim 20, wherein if said main controller is abnormal, said sub controller has a function of informing the user of abnormality of said main controller.

27. The emergency informing terminal of claim 21, wherein if said main controller is not normally restored by the reset signal but remains abnormal, said sub controller has a function of informing the user of abnormality of said main controller.

28. The emergency informing terminal of claim 26, wherein if said main controller is not normally restored by the reset signal but remains abnormal, said sub controller has a function of informing the user of abnormality of said main controller.

29. An emergency informing terminal mounted on a vehicle or other mobile body having an air bag for communicating with a center for supervising an emergency informing system, comprising:

a main controller and a sub controller for controlling the emergency informing terminal, said sub controller also for controlling communications with an external device, said main controller and said sub controller monitor each other, and wherein operation of said air bag is monitored by the sub controller acquiring periodic communication signals from the air bag.

30. The emergency informing terminal of claim 29, wherein said main controller acquires periodic communication signals from the air bag, and issues a signal proving acquisition of periodic communication signals to said sub controller, and said sub controller monitors the operation of the air bag and said main controller.

31. The emergency informing terminal of claim 29, wherein said sub controller acquires periodic communication signals from the air bag, and issues a signal proving acquisition of periodic communication signals to said main controller, and said main controller monitors the operation of the air bag and said sub controller.

32. The emergency informing terminal of claim 30, wherein said main controller issues other periodic communication signals than the periodic communication signals from the air bag, and monitors the operation of the air bag and said main controller, and if either the periodic communication signals from the air bag or the other periodic communication signals from said main controller are not normally entered in said sub controller, said sub controller judges abnormality of either the air bag or said main controller.

33. The emergency informing terminal of claim 31, wherein said sub controller issues other periodic communication signals than the periodic communication signals from the air bag, and monitors the operation of the air bag and said sub controller, and if either the periodic communication signals from the air bag or the other periodic communication signals from said sub controller are not normally entered in said main controller, said main controller judges abnormality of either the air bag or said sub controller.

34. The emergency informing terminal of claim 31, wherein said main controller monitors the periodic communication signals showing the status of the air bag from said sub controller and other periodic communication signals issued from said sub controller, and if the monitored periodic communication signals or other periodic communication signals are other than normal signal or are not received, it judges abnormality of the air bag or said sub controller.

35. The emergency informing terminal of claim 34, wherein said main controller judges abnormality of the air bag if the monitored periodic communication signals showing the status of the air bag are other than normal signals or are not received.

36. The emergency informing terminal of claim 34, wherein said main controller judges abnormality of said sub controller if the monitored other periodic communication signals issued by said sub controller are other than normal signals or are not received.

37. The emergency informing terminal of claim 34, wherein said main controller processes to record abnormality of the air bag or said sub controller in history if the monitored periodic communication signals or other periodic communication signals issued by said sub controller are other than normal signals or are not received.

38. The emergency informing terminal of claim 31, wherein said main controller monitors the periodic communication signals showing the status of the air bag from said sub controller and other periodic communication signals issued from said sub controller, and issues response signals to the periodic communication signals showing the status of the air bag and other periodic communication signals issued from said sub controller.

39. An emergency informing terminal mounted on a vehicle or other mobile body, for communicating with a center for supervising an emergency informing system, by switching power supply between a main battery of the mobile body and a power supply from an auxiliary battery, a main controller and a sub controller for controlling the emergency informing terminal, said sub controller also for controlling communications with an external device, said main controller and said sub controller monitor each other, and wherein means for cutting off power supply into the emergency informing terminal is provided in the auxiliary battery.

40. The emergency informing terminal of claim 39, wherein said means for cutting off power supply judges abnormal when the voltage in the auxiliary battery is lowered below a specific voltage, and cuts off power supply to the emergency informing terminal.

41. The emergency informing terminal of claim 39, wherein said means for cutting off power supply monitors the supply voltage of the supply source produced from the auxiliary battery, and judges abnormal when the supply voltage is lowered below a specific voltage, and cuts off power supply to the emergency informing terminal.

42. The emergency informing terminal of claim 40 or 41, wherein said means for cutting off power supply can adjust the judging voltage for judging abnormal when the supply voltage is lowered below a specific voltage.

43. The emergency informing terminal of claim 42, wherein a plurality of resistors connected parallel to the power source are used for adjustment of the judging voltage.

44. The emergency informing terminal of claim 43, wherein said partial voltage generated by dividing the supply voltage by the plural resistors is used as the judging voltage.

45. The emergency informing terminal of claim 41, wherein in the case of the auxiliary battery composed of plural cells connected in parallel or in series, said means for cutting off power supply has a plurality of supply voltage detecting means for detecting drop below a specific voltage.

46. The emergency informing terminal of claim 45, wherein supply voltage detecting means are disposed in individual cells of the auxiliary battery.

47. The emergency informing terminal of claim 39, wherein said means for cutting off power supply judges abnormal when the current from the auxiliary battery exceeds a specific current, and cuts off the power source.

48. The emergency informing terminal of claim 47, wherein in the case of the battery composed of plural cells connected in parallel or in series, said means for cutting off power supply has a plurality of supply current detecting means for detecting rise above a specific current.

49. The emergency informing terminal of claim 48, wherein said supply current detecting means are disposed in individual cells of the auxiliary battery.

50. The emergency informing terminal of claim 39, wherein said means for cutting off power supply judges abnormal when the cells of the auxiliary battery generate heat to exceed a specific temperature, and cuts off the power source.

51. The emergency informing terminal of claim 50, wherein said means for cutting off power supply is composed of an overcurrent and overheat protective element.

52. The emergency informing terminal of any one of claims 39 to 41, wherein lithium primary cells are used as cells for the auxiliary battery.

53. The emergency informing terminal of any one of claims 39 to 41, wherein the auxiliary battery is a battery module having three or more cells connected in series.

54. An emergency informing terminal mounted on a vehicle or other mobile body, for communicating with a center for supervising an emergency informing system, by switching power supply between a main battery of the mobile body and a power supply from an auxiliary battery, a main controller and a sub controller for controlling the emergency informing terminal, said sub controller also for controlling communications with an external device, said main controller and said sub controller monitor each other, and wherein said auxiliary battery includes a battery module composed of a plurality of cells connected in series, and a plurality of diodes connected parallel to said plurality of cells of said battery module.

55. The emergency informing terminal of claim 54, wherein cathode of each said plurality of diodes is connected to the plus terminal of each of said plurality of cells, and anode of each of said plurality of diodes is connected to minus terminal of each of said plurality of cells.

56. The emergency informing terminal of claim 54 or 55, wherein each of said plurality of diode is connected parallel to each of said plurality cells.

57. The emergency informing terminal of claim 54 or 55, wherein each of said plurality of diode is connected to every two cells of said plurality of cells.

58. The emergency informing terminal of claim 54 or 55, wherein said plurality of cells comprise a first cell, a second cell, a third cell, a fourth cell, and fifth cell, said plurality of diodes comprise a first diode, a second diode, and a third diode, and said first diode is connected parallel to said first cell and second cell connected in series, said second diode parallel to said third cell and fourth cell connected in series, and said third diode parallel to said fifth cell.

59. The emergency informing terminal of claim 54 or 55, wherein said plurality cells comprise a first cell, a second cell, a third cell, a fourth cell, and a fifth cell, said plurality of diodes comprise a first diode, a second diode, and a third diode, and said first diode is connected parallel to said first cell and second cell connected in series, said second diode parallel to said third cell, and said third diode parallel to said fourth cell and said fifth cell connected in series.

60. The emergency informing terminal of claim 54 or 55, wherein said plurality of cells comprise a first cell, a second cell, a third cell, a fourth cell, and a fifth cell, said plurality of diodes include a first diode, a second diode, and a third diode, and said first diode is connected parallel to said first cell, said second diode parallel to said second cell and said third cell connected in series, and said third diode parallel to said fourth cell and said fifth cell connected in series.

61. An emergency informing system comprising:

an emergency informing terminal mounted on a vehicle or other mobile body having an air bag, and an emergency call center for receiving an emergency call send signal from the emergency informing terminal, a main controller and a sub controller for controlling the emergency informing terminal, said sub controller also for controlling communications with an external device, said main controller and said sub controller monitor each other, and wherein the emergency informing terminal monitors the operation of the air bag by acquiring periodic communication signals from the air bag.

62. An emergency informing system comprising:

an emergency informing terminal mounted on a vehicle or other mobile body, for providing a continuous emergency call notifying process, by switching power supply between a main battery of the mobile body and a power supply from an auxiliary battery, and a main controller and a sub controller for controlling the emergency informing terminal, said sub controller also for controlling communications with an external device, said main controller and said sub controller monitor each other, an emergency call center for receiving an emergency call send signal from the emergency informing terminal, wherein the auxiliary battery includes means for cutting off power supply into the emergency informing terminal in the event of abnormality of the power source.

* * * * *